US012338408B2

(12) United States Patent
Susukida et al.

(10) Patent No.: US 12,338,408 B2
(45) Date of Patent: Jun. 24, 2025

(54) LUBRICATING OIL COMPOSITION

(71) Applicant: ENEOS Corporation, Tokyo (JP)

(72) Inventors: Yohei Susukida, Tokyo (JP); Yasushi Onumata, Tokyo (JP); Akira Tada, Tokyo (JP); Noriko Ayame, Tokyo (JP)

(73) Assignee: ENEOS CORPORATION, Tokyo (JP)

( * ) Notice: Subject to any disclaimer, the term of this patent is extended or adjusted under 35 U.S.C. 154(b) by 0 days.

(21) Appl. No.: 17/289,961

(22) PCT Filed: Nov. 6, 2019

(86) PCT No.: PCT/JP2019/043567

§ 371 (c)(1),
(2) Date: Apr. 29, 2021

(87) PCT Pub. No.: WO2020/095968

PCT Pub. Date: May 14, 2020

(65) Prior Publication Data

US 2021/0395634 A1 Dec. 23, 2021

(30) Foreign Application Priority Data

Nov. 6, 2018 (JP) ..... 2018-209255
Nov. 6, 2018 (JP) ..... 2018-209266
Nov. 6, 2018 (JP) ..... 2018-209267

(51) Int. Cl.

| | |
|---|---|
| ***C10M 141/00*** | (2006.01) |
| ***C10M 129/54*** | (2006.01) |
| ***C10M 133/12*** | (2006.01) |
| ***C10M 133/44*** | (2006.01) |
| ***C10M 135/10*** | (2006.01) |
| ***C10M 137/02*** | (2006.01) |
| ***C10M 139/00*** | (2006.01) |
| ***C10M 141/10*** | (2006.01) |
| ***C10M 169/04*** | (2006.01) |
| ***C10M 177/00*** | (2006.01) |
| *C10N 30/00* | (2006.01) |
| *C10N 30/02* | (2006.01) |
| *C10N 30/04* | (2006.01) |
| *C10N 30/10* | (2006.01) |
| *C10N 30/14* | (2006.01) |

(Continued)

(52) U.S. Cl.

CPC ..... *C10M 141/10* (2013.01); *C10M 129/54* (2013.01); *C10M 133/12* (2013.01); *C10M 133/44* (2013.01); *C10M 135/10* (2013.01); *C10M 137/02* (2013.01); *C10M 139/00* (2013.01); *C10M 169/04* (2013.01); *C10M 177/00* (2013.01); *C10M 2203/003* (2013.01); *C10M 2207/144* (2013.01); *C10M 2215/26* (2013.01); *C10M 2215/30* (2013.01); *C10M 2219/044* (2013.01); *C10M 2223/049* (2013.01); *C10M 2227/061* (2013.01); *C10N 2030/02* (2013.01); *C10N 2030/04* (2013.01); *C10N 2030/041* (2020.05); *C10N 2030/10* (2013.01); *C10N 2030/14* (2013.01); *C10N 2030/42* (2020.05); *C10N 2040/04* (2013.01); *C10N 2040/25* (2013.01); *C10N 2040/40* (2020.05); *C10N 2070/00* (2013.01)

(58) Field of Classification Search

CPC ..... C10M 141/10; C10M 137/02; C10M 133/44; C10M 135/10; C10M 129/54; C10M 139/00; C10M 133/12; C10M 169/04; C10M 2207/144; C10M 2223/049; C10M 2215/26; C10M 2219/044; C10M 2203/003; C10M 2215/30; C10M 2227/061; C10N 2040/40; C10N 2030/14; C10N 2030/041; C10N 2030/02; C10N 2030/10; C10N 2040/04

See application file for complete search history.

(56) References Cited

U.S. PATENT DOCUMENTS 5,840,663 A 11/1998 Nibert et al.
6,103,673 A 8/2000 Sumiejski et al.

(Continued)

FOREIGN PATENT DOCUMENTS

CN 104845706 8/2015
EP 0987311 3/2000

(Continued)

OTHER PUBLICATIONS

ISR issued in WIPO Patent Application No. PCT/JP2019/043567, Feb. 10, 2020, English translation.
IPRP issued in WIPO Patent Application No. PCT/JP2019/043567, May 11, 2021, English translation.
Final Office Action issued in U.S. Appl. No. 17/289,993, Mar. 10, 2022.
Office Action issued in U.S. Appl. No. 17/290,496, Jun. 10, 2022.
ISR of PCT/JP2019/043569, Feb. 10, 2020, translation.
IPRP of PCT/JP2019/043569, May 11, 2021, translation.
ISR of PCT/JP2019/043568, Feb. 10, 2020, translation.

(Continued)

*Primary Examiner* — Taiwo Oladapo
(74) *Attorney, Agent, or Firm* — GREENBLUM & BERNSTEIN, P.L.C.

(57) ABSTRACT

A lubricating oil composition including: a lubricant base oil; (A) a calcium salicylate detergent in an amount of 0.005 to 0.03 mass % in terms of calcium on the basis of the total mass of the composition; (B) a succinimide ashless dispersant in an amount of 0.005 to 0.25 mass % in terms of nitrogen on the basis of the total mass of the composition; (C) a nitrogen-containing antioxidant in an amount of 0.005 to 0.15 mass % in terms of nitrogen on the basis of the total mass of the composition; and optionally (D) a nitrogen-containing friction modifier in an amount of no more than 0.03 mass % in terms of nitrogen on the basis of the total mass of the composition, wherein a total content of any metallic detergent is 0.005 to 0.03 mass % in terms of metal on the basis of the total mass of the composition.

17 Claims, No Drawings

(51) Int. Cl.

| | |
|---|---|
| *C10N 40/00* | (2006.01) |
| *C10N 40/04* | (2006.01) |
| *C10N 40/25* | (2006.01) |
| *C10N 70/00* | (2006.01) |

(56) References Cited

U.S. PATENT DOCUMENTS

| | | | | |
|---|---|---|---|---|
| 8,987,178 | B2 | 3/2015 | Davies et al. | |
| 2002/0010102 | A1 | 1/2002 | Koshima et al. | |
| 2004/0192562 | A1* | 9/2004 | Morita | C10M 163/00 508/185 |
| 2004/0209786 | A1* | 10/2004 | Sagawa | C10M 137/04 508/371 |
| 2005/0250656 | A1 | 11/2005 | Ishikawa et al. | |
| 2008/0058233 | A1 | 3/2008 | Sagawa et al. | |
| 2008/0110799 | A1 | 5/2008 | Matsui et al. | |
| 2010/0130390 | A1* | 5/2010 | Tipton | C10M 141/10 508/273 |
| 2010/0137173 | A1 | 6/2010 | Sheets et al. | |
| 2011/0028364 | A1 | 2/2011 | Shrestha et al. | |
| 2012/0090568 | A1* | 4/2012 | Teshima | C10M 163/00 123/1 A |
| 2014/0018271 | A1 | 1/2014 | Onumata et al. | |
| 2016/0108337 | A1 | 4/2016 | Abraham et al. | |
| 2017/0204046 | A1* | 7/2017 | Kishi | C07C 69/33 |
| 2018/0087002 | A1* | 3/2018 | Komatsubara | C10M 135/36 |
| 2018/0100117 | A1 | 4/2018 | Flores-Torres et al. | |
| 2018/0100118 | A1 | 4/2018 | Flores-Torres et al. | |
| 2020/0332216 | A1 | 10/2020 | Hamachi | |
| 2021/0122994 | A1 | 4/2021 | Fang et al. | |
| 2021/0395635 | A1 | 12/2021 | Susukida et al. | |
| 2022/0002631 | A1 | 1/2022 | Susukida et al. | |
| 2022/0025292 | A1 | 1/2022 | Tamura | |

FOREIGN PATENT DOCUMENTS

| | | | | |
|---|---|---|---|---|
| EP | 1405897 | A1 * | 4/2004 | C10M 137/04 |
| JP | 09-202890 | | 8/1997 | |
| JP | 09-328698 | | 12/1997 | |
| JP | 11-171892 | | 6/1999 | |
| JP | 2000-087068 | | 3/2000 | |
| JP | 2003-113391 | | 4/2003 | |
| JP | 2005-325355 | | 11/2005 | |
| JP | 2008-285682 | | 11/2008 | |
| JP | 2010-530470 | | 9/2010 | |
| JP | 2011-046938 | | 3/2011 | |
| JP | 2012-207083 | | 10/2012 | |
| JP | 104845706 | | 8/2015 | |
| JP | 2016-108406 | | 6/2016 | |
| JP | 2016-190953 | | 11/2016 | |
| JP | 2018-053017 | | 4/2018 | |
| WO | 2007/052826 | | 5/2007 | |

OTHER PUBLICATIONS

IPRP of PCT/JP2019/043568, May 11, 2021, translation.
U.S. OA issued in U.S. Appl. No. 17/289,993, Nov. 2, 2021.
U.S. OA issued in U.S. Appl. No. 17/290,496, Nov. 19, 2021.
Notice of Allowance issued in U.S. Appl. No. 17/290,496, Nov. 4, 2022.

* cited by examiner

LUBRICATING OIL COMPOSITION

FIELD

The present invention relates to a lubricating oil composition, and specifically to a lubricating oil composition suitable for lubrication of electric motors.

BACKGROUND

In recent years, electric vehicles which use an electric motor as a power source for running, and hybrid vehicles which use an electric motor and an internal combustion engine together as a power source for running are attracting interest in view of energy efficiency and environmental compatibility. While generating heat during operation thereof, electric motors include a heat-sensitive component such as a coil and a magnet. Those vehicles which run using an electric motor as a power source for running are thus provided with means for cooling the electric motor. Known means for cooling the electric motor include air cooling, water cooling and oil cooling. Among them, oil cooling is to circulate oil in the electric motor, to directly make a part in the electric motor which generates heat (such as a coil, a core and a magnet) contact with a coolant (oil), which makes it possible to obtain a high cooling effect. In the electric motor using oil cooling, oil (lubricating oil) is circulated in the electric motor, to cool and lubricate the electric motor at the same time. Electrical insulation is required of a lubricating oil (electric motor oil) of the electric motor.

Vehicles which use an electric motor as a power source for running usually include a transmission having a gear mechanism. Various additives are incorporated into a lubricating oil to lubricate the gear mechanism since anti-wear performance and anti-fatigue performance are required of the lubricating oil.

CITATION LIST

Patent Literature

[Patent Literature 1] JP 2003-113391 A
[Patent Literature 2] JP H9-328698 A
[Patent Literature 3] JP 2018-053017 A

SUMMARY

Technical Problem

A lubricating oil used for lubricating electric motors is usually different from that used for lubricating transmissions. If electric motors and transmissions (gear mechanisms) can be lubricated using the same lubricating oil, lubricating oil circulation systems can be simplified. Recently, an electric drive module into which an electric motor and a transmission (gear mechanism) are integrated as one device (package) has been also proposed. For lubrication of such an electric drive module, it is desirable to lubricate an electric motor and a transmission (gear mechanism) using the same lubricating oil in view of downsizing and weight reduction.

Disadvantageously, conventional transmission oils suffer insufficient electrical insulation when they are oxidatively deteriorated by the use thereof even if electrical insulation of fresh oils thereof is improved for a use for lubrication of electric motors. Anti-fatigue performance of conventional electric motor oils are not enough for a use for lubrication of transmissions (gear mechanisms).

An object of the present invention is to provide a lubricating oil composition having anti-fatigue performance and electrical insulation of the oxidatively deteriorated composition in a well-balanced manner.

Solution to Problem

The present invention encompasses the following [1] to [17].

[1] A lubricating oil composition comprising: a lubricant base oil; (A) a calcium salicylate detergent in an amount of 0.005 to 0.03 mass % in terms of calcium on the basis of the total mass of the composition; (B) a succinimide ashless dispersant in an amount of 0.005 to 0.25 mass % in terms of nitrogen on the basis of the total mass of the composition; (C) a nitrogen-containing antioxidant in an amount of 0.005 to 0.15 mass % in terms of nitrogen on the basis of the total mass of the composition; and optionally (D) a nitrogen-containing friction modifier in an amount of no more than 0.03 mass % in terms of nitrogen on the basis of the total mass of the composition, wherein a total content of any metallic detergent is 0.005 to 0.03 mass % in terms of metal on the basis of the total mass of the composition.

[2] The lubricating oil composition according to [1], wherein a proportion of any salicylate in a total soap group content of the metallic detergent is no less than 65 mol %.

[3] The lubricating oil composition according to [1] or [2], wherein the component (C) is at least one aromatic amine antioxidant or at least one hindered amine antioxidant or any combination thereof.

[4] The lubricating oil composition according to any one of [1] to [3], wherein a content of the component (D) is a total content of any aliphatic amine compound having a C8-36 aliphatic hydrocarbyl group other than a succinimide ashless dispersant and an amine antioxidant, and any compound having a C8-36 aliphatic hydrocarbyl or aliphatic hydrocarbylcarbonyl group and an amide bond other than a succinimide ashless dispersant and an amine antioxidant.

[5] The lubricating oil composition according to any one of [1] to [4], further comprising: (D1) a succinimide friction modifier in an amount of 0.001 to 0.03 mass % in terms of nitrogen on the basis of the total mass of the composition.

[6] The lubricating oil composition according to [5], the component (D1) being a first condensation reaction product, or a derivative thereof, or any combination thereof, the first condensation reaction product being a condensation reaction product of a first alkyl- or alkenyl-succinic acid or anhydride thereof and a first polyamine, the first alkyl- or alkenyl-succinic acid having a C8-36 alkyl or alkenyl group, the first polyamine being a polyamine, a N-mono-C1-36 alkylated product of the polyamine, or a N-mono-C1-36 alkenylated product of the polyamine, or any mixture thereof.

[7] The lubricating oil composition according to any one of [1] to [6], wherein the component (B) is a second condensation reaction product, or a derivative thereof, or any combination thereof, the second condensation reaction product being a condensation reaction product of a second alkyl- or alkenyl-succinic acid or anhydride thereof and a polyamine, the second alkyl- or alkenyl-succinic acid having a C40-400 alkyl or alkenyl group.

[8] The lubricating oil composition according to any one of [1] to [7], further comprising: (E) a phosphite ester compound represented by the following general formula (8) in an amount of 0.01 to 0.06 mass % in terms of phosphorus on the basis of the total mass of the composition:

(8)

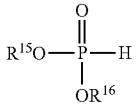

wherein in the general formula (8), $R^{15}$ and $R^{16}$ are each independently a C1-18 linear chain hydrocarbon group or a C5-20 group represented by the following general formula (9):

(9)

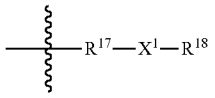

wherein in the general formula (9), $R^{17}$ is a C2-17 linear chain hydrocarbon group, and $R^{18}$ is a C3-17 linear chain hydrocarbon group, and $X^1$ is an oxygen atom or a sulfur atom.

[9] The lubricating oil composition according to any one of [1] to [8], further comprising: (F) a tolyltriazole metal deactivator and/or a benzotriazole metal deactivator, in an amount of 0.001 to 0.1 mass % on the basis of the total mass of the composition.

[10] The lubricating oil composition according to any one of [1] to [9], wherein the composition has a kinematic viscosity at 40° C. of 4 to 20 $mm^2/s$; and the composition has a kinematic viscosity at 100° C. of 1.8 to 4.0 $mm^2/s$.

[11] The lubricating oil composition according to any one of [1] to [10], wherein a total phosphorus content in the lubricating oil composition is no more than 0.06 mass % in terms of phosphorus on the basis of the total mass of the composition.

[12] The lubricating oil composition according to any one of [1] to [11], wherein a total content of any metal element in the lubricating oil composition is no more than 0.03 mass % in terms of metal on the basis of the total mass of the composition.

[13] The lubricating oil composition according to any one of [1] to [12], wherein a total content of any compound having an O/N-based active hydrogen compound is 0 to 500 mass ppm in terms of the sum of oxygen content and nitrogen content on the basis of the total mass of the lubricating oil composition, the compound not contributing to any content of the metallic detergent, the succinimide ashless dispersant, the amine antioxidant, the succinimide friction modifier, a phosphite diester compound that does not have an O/N-based active hydrogen-containing group in its alcohol residue, and a triazole metal deactivator, the O/N-based active hydrogen-containing group representing a non-phenolic OH group that may be part of any other functional group, or a salt thereof, >NH group, or —$NH_2$ group.

[14] The lubricating oil composition according to any one of [1] to [13], wherein an oxidatively deteriorated oil of the composition has a volume resistivity at 80° C. of no less than $1.0\times10^9$ Ω·cm, wherein the oxidatively deteriorated oil is obtained by oxidatively treating the composition for 150 hours by ISOT method conforming to JIS K2514-1.

[15] The lubricating oil composition according to any one of [1] to [14], wherein the composition is used to lubricate an electric motor or to lubricate the electric motor and a transmission, in an automobile comprising the electric motor.

[16] A method for lubricating an electric motor, the method comprising: lubricating an electric motor installed in an automobile, by means of the lubricating oil composition as defined in any one of [1] to [15].

[17] A method for lubricating an electric motor and a transmission, the method comprising: lubricating an electric motor and a transmission installed in an automobile, by means of the lubricating oil composition as defined in any one of [1] to [15].

Advantageous Effects

The first aspect of the present invention can provide a lubricating oil composition having anti-fatigue performance and electrical insulation of the oxidatively deteriorated composition in a well-balanced manner.

The lubricating oil composition according to the first aspect of the present invention may be preferably used in the lubricating method according to the second aspect of the present invention.

DESCRIPTION OF EMBODIMENTS

The present invention will be described hereinafter. In the present description, expression "A to B" concerning numeral values A and B means "no less than A and no more than B" unless otherwise specified. In such expression, if a unit is added only to the numeral value B, the unit is applied to the numeral value A as well. Also, a word "or" means a logical sum unless otherwise specified. In the present description, expression "$E_1$ and/or $E_2$" concerning elements $E_1$ and $E_2$ means "$E_1$, or $E_2$, or the combination thereof", and expression "$E_1$, . . . , $E_{N-1}$, and/or $E_N$" concerning elements $E_1$, . . . , $E_N$ (N is an integer of 3 or more) means "$E_1$, . . . , $E_{N-1}$, or $E_N$, or any combination thereof".

<Lubricating Base Oil>

As a lubricating base oil in a lubricating oil composition according to the present invention (hereinafter may be referred to as "lubricating oil composition" or simply "composition"), at least one mineral base oil, at least one synthetic base oil, or any mixed base oil thereof may be used and in one embodiment, a Group II base oil, a Group III base oil, a Group IV base oil, or a Group V base oil of API base stock categories, or a mixed base oil thereof may be preferably used. An API Group II base oil is a mineral base oil containing no more than 0.03 mass % sulfur and no less than 90 mass % saturates, and having a viscosity index of no less than 80 and less than 120. An API Group III base oil is a mineral base oil containing no more than 0.03 mass % sulfur and no less than 90 mass % saturates, and having a viscosity index of no less than 120. An API Group IV base oil is a poly-α-olefin base oil. An API Group V base oil is a base oil other than the foregoing Groups I to IV base oils, and preferred examples thereof includes ester base oils.

The mineral base oil may be, for example, a paraffinic or naphthenic mineral base oil obtained through application of one or at least two of refining means in suitable combination, such as solvent deasphalting, solvent extraction, hydrocracking, solvent dewaxing, catalytic dewaxing, hydrorefining, sulfuric acid washing, and white clay treatment, to lubricant oil fractions that are obtained by distillation of crude oil under atmospheric pressure and under reduced pressure. API Group II base oils and Group III base oils are usually produced via hydrocracking. A wax isomerized base oil, a base oil produced by a process of isomerizing GTL WAX (gas to liquid wax), or the like may be also used.

Examples of the API Group IV base oil include ethylene-propylene copolymers, polybutene, 1-octene oligomers, and 1-decene oligomers, and hydrogenated products thereof.

Examples of the API Group V base oil include monoesters (such as butyl stearate, octyl laurate, and 2-ethylhexyl oleate); diesters (such as ditridecyl glutarate, bis(2-ethylhexyl) adipate, diisodecyl adipate, ditridecyl adipate, and bis(2-ethylhexyl) sebacate); polyesters (such as trimellitate esters); and polyol esters (such as trimethylolpropane caprylate, trimethylolpropane pelargonate, pentaerythritol 2-ethylhexanoate, and pentaerythritol pelargonate).

The lubricating base oil (total base oil) may comprise one base oil, and may be a mixed base oil comprising at least two base oils. In the mixed base oil comprising at least two base oils, the API base stock categories of these base oils may be the same, and may be different from each other. The content of the API Group V base oil is preferably 0 to 20 mass %, and is more preferably 0 to 15 mass %; and in one embodiment may be 0 to 10 mass %, on the basis of the total mass of the lubricating base oil. The content of the ester base oil at the above described upper limit or less can offer improved oxidation stability of the lubricating oil composition.

The kinematic viscosity of the lubricating base oil (total base oil) at 100° C. is preferably 1.7 to 4.0 $mm^2/s$, and is more preferably 2.2 to 3.0 $mm^2/s$; and in one embodiment may be 1.7 to 3.5 $mm^2/s$. The kinematic viscosity of the lubricating base oil at 100° C. at the above described upper limit or less can lead to improved fuel efficiency. The kinematic viscosity of the lubricating base oil at 100° C. at the above described lower limit or more can lead to further improved anti-wear performance and anti-fatigue performance, and improved electrical insulation of a fresh oil. In the present description, "kinematic viscosity at 100° C." means a kinematic viscosity at 100° C. specified in ASTM D-445.

The kinematic viscosity of the lubricating base oil (total base oil) at 40° C. is preferably 5.0 to 20.0 $mm^2/s$, and is more preferably 7.0 to 12.0 $mm^2/s$; and in one embodiment may be 5.0 to 14.7 $mm^2/s$. The kinematic viscosity of the lubricating base oil at 40° C. at the above described upper limit or less can lead to improved fuel efficiency. The kinematic viscosity of the lubricating base oil at 40° C. at the above described lower limit or more can lead to further improved anti-wear performance and anti-fatigue performance, and improved electrical insulation of a fresh oil. In the present description, "kinematic viscosity at 40° C." means a kinematic viscosity at 40° C. specified in ASTM D-445.

The viscosity index of the lubricating base oil (total base oil) is preferably no less than 100, and more preferably no less than 105; and in one embodiment, may be no less than 110, may be no less than 120, and may be no less than 125. The viscosity index of the lubricating base oil at the above described lower limit or more can lead to improved viscosity-temperature characteristics and thermal and oxidation stability, a reduced friction coefficient, and improved anti-wear performance of the lubricating oil composition. In the present description, a viscosity index means a viscosity index measured conforming to JIS K 2283-1993.

The sulfur content in the lubricating base oil (total base oil) is, in view of oxidation stability, preferably no more than 0.03 mass % (300 mass ppm), more preferably no more than 50 mass ppm, and especially preferably no more than mass ppm, and may be no more than 1 mass ppm.

The lubricating base oil (total base oil) is a major constituent of the lubricating oil composition. The content of the lubricating base oil (total base oil) in the lubricating oil composition is preferably 80 to 98 mass %, and is more preferably 83 to 90 mass %; and in one embodiment may be 83 to 93 mass %, on the basis of the total mass of the composition.

<(A) Calcium Salicylate Detergent>

The lubricating oil composition of the present invention comprises (A) a calcium salicylate detergent (hereinafter may be simply referred to as "component (A)"). As the component (A), a calcium salicylate, or a basic salt or overbased salt thereof may be used. As the component (A), one calcium salicylate detergent may be used alone, or at least two calcium salicylate detergents may be used in combination. Examples of the calcium salicylate include any compound represented by the following general formula (1).

(1)

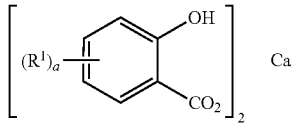

In the general formula (1), $R^1$ each independently represent a C14-30 alkyl or alkenyl group; and a represents 1 or 2, and is preferably 1. The compound represented by the general formula (1) may be a mixture of any compound where a=1 and any compound where a=2. When a=2, $R^1$ may be any combination of different groups.

One preferred embodiment of the calcium salicylate detergent may be a calcium salicylate represented by the above general formula (1) where a=1, or a basic salt or overbased salt thereof.

A method of producing the calcium salicylate is not particularly restricted, and a known method of producing monoalkylsalicylates or the like may be used. For example, the calcium salicylate may be obtained by: making a calcium base such as oxides and hydroxides of calcium react with a monoalkylsalicylic acid obtained by alkylating a phenol as a starting material with an olefin, and then carboxylating the resultant product with carbonic acid gas or the like, or with a monoalkylsalicylic acid obtained by alkylating a salicylic acid as a starting material with an equivalent of the olefin, or the like; converting the above monoalkylsalicylic acid or the like to an alkali metal salt such as a sodium salt and a potassium salt, and then performing transmetallation with a calcium salt; or the like.

A method of obtaining the overbased calcium salicylate is not particularly restricted. For example, a calcium salicylate is made to react with a calcium base such as calcium hydroxide in the presence of carbonic acid gas, which makes it possible to obtain the overbased calcium salicylate.

The base number of the component (A) is not particularly limited, but is preferably 50 to 350 mgKOH/g, more preferably 100 to 350 mgKOH/g, and especially preferably 150 to 350 mgKOH/g. The base number of the component (A) at the above described lower limit or more can lead to further improved electrical insulation of the oxidatively deteriorated composition.

The content of the component (A) in the lubricating oil composition is 0.005 to 0.03 mass % in terms of calcium on the basis of the total mass of the lubricating oil composition. The content of the component (A) at the above described upper limit or less can lead to improved electrical insulation of a fresh oil and the oxidatively deteriorated composition.

The content of the component (A) at the above described lower limit or more can lead to improved anti-fatigue performance.

The lubricating oil composition may comprise the component (A) only, and may further comprise at least one metallic detergent other than the calcium salicylate detergent (such as a calcium sulfonate detergent and a calcium phenate detergent) in addition to the component (A), as a metallic detergent. The total content of the metallic detergent in the lubricating oil composition is 0.005 to 0.03 mass % in terms of metal on the basis of the total mass of the composition. The total content of the metallic detergent in the lubricating oil composition at the above described upper limit or less can lead to further improved electrical insulation of a fresh oil and the oxidatively deteriorated composition. The proportion of total salicylates in the total soap group content of the metallic detergent is preferably 65 to 100 mol %, and more preferably 90 to 100 mol %. Contribution of salicylates to the total soap group content of the metallic detergent at the above described lower limit or more can lead to further improved anti-fatigue performance. In the present description, "the proportion of salicylates to the total soap group content of the metallic detergent" means the proportion (mol %) of the total negative charges (mol) of salicylate ions in the salicylate detergent to the total negative charges (mol) of the soap group of the metallic detergent.

<(B) Succinimide Ashless Dispersant>

The lubricating oil composition according to the present invention comprises (B) a succinimide ashless dispersant (hereinafter may be referred to as "component (B)"). As the component (B), a boronated succinimide ashless dispersant may be used, a non-boronated succinimide ashless dispersant may be used, or both may be used in combination. In view of further improving electrical insulation of an oxidatively deteriorated oil, the component (B) preferably comprises a non-boronated succinimide ashless dispersant.

As the component (B), for example, succinimide having at least one C40-400, preferably C60-350 alkyl or alkenyl group in its molecule, or any derivative (modified compound) thereof may be used. Examples of succinimide having at least one alkyl or alkenyl group in its molecule include any compound represented by the following general formula (2) or (3).

(2)

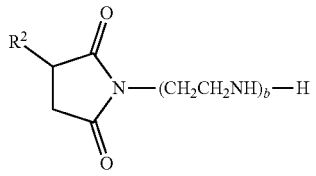

(3)

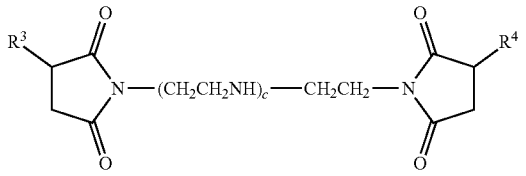

In the general formula (2), $R^2$ represents a C40-400 alkyl or alkenyl group; and b is an integer of 1 to 5, preferably 2 to 4. The compound represented by the general formula (2) may be a mixture of a plurality of the compounds having different values of b. The carbon number of $R^2$ is preferably 60 to 350.

In the general formula (3), $R^3$ and $R^4$ each independently represent a C40-400 alkyl or alkenyl group, and may be any combination of different groups; and c is an integer of 0 to 4, preferably 1 to 4, more preferably 1 to 3. The compound represented by the general formula (3) may be a mixture of a plurality of the compounds having different values of c. The carbon numbers of $R^3$ and $R^4$ are preferably 60 to 350.

The carbon numbers of $R^2$ to $R^4$ in the general formulae (2) and (3) at the above described lower limits or more make it possible to obtain good solubility in the lubricating base oil. In contrast, the carbon numbers of $R^2$ to $R^4$ at the above described upper limits or less can lead to improved low-temperature fluidity of the lubricating oil composition.

The alkyl or alkenyl groups ($R^2$ to $R^4$) in the general formulae (2) and (3) may be linear chain or branched, and preferred examples thereof include branched alkyl groups and branched alkenyl groups derived from oligomers of olefins such as propylene, 1-butene, and isobutene, or from co-oligomers of ethylene and propylene. Among them, a branched alkyl or alkenyl group derived from oligomers of isobutene that are conventionally referred to as polyisobutylene, or a polybutenyl group is most preferable.

Preferred number average molecular weights of the alkyl or alkenyl groups ($R^2$ to $R^4$) in the general formulae (2) and (3) are 1000 to 3500.

Succinimide having at least one alkyl or alkenyl group in its molecule includes so-called monotype succinimide represented by the general formula (2) where only an amino group at one terminal of a polyamine chain is imidated, and so-called bistype succinimide represented by the general formula (3) where amino groups at both terminals of a polyamine chain are imidated. The component (B) may comprise either monotype or bistype succinimide, or may comprise both as a mixture. The content of bistype succinimide or any derivative thereof in the component (B) is preferably no less than 50 mass %, and more preferably no less than 70 mass %, on the basis of the total mass of the component (B) (100 mass %).

A method for producing succinimide having at least one alkyl or alkenyl group in its molecule is not specifically limited. For example, such succinimide may be obtained as a condensation reaction product by: reaction of alkyl- or alkenyl-succinic acid having a C40-400 alkyl or alkenyl group or anhydride thereof, with a polyamine. As the component (B), such a condensation product may be used as it is, or may be converted into a derivative (modified compound) described later to be used. The condensation product of alkyl- or alkenyl-succinic acid or anhydride thereof, and a polyamine may be bistype succinimide where both terminals of a polyamine chain are imidated (see the general formula (3)), may be monotype succinimide where only one terminal of a polyamine chain is imidated (see the general formula (2)), or may be a mixture thereof. Here, an alkenyl-succinic acid anhydride having a C40-400 alkenyl group may be obtained by reaction of a C40-400 alkene and maleic anhydride, and an alkyl-succinic acid anhydride having a C40-400 alkyl group may be obtained by a catalytic hydrogenation reaction of such an alkenyl-succinic acid anhydride. Examples of an alkene to react with maleic anhydride may include oligomers of olefins and co-oligomers of ethylene and propylene as described above, and may include isobutene oligomers. Examples of a polyamine include diethylenetriamine, triethylenetetramine, tetraethylenepentamine, and pentaethylenehexamine, and any mixtures thereof, and a polyamine raw material comprising at least one selected therefrom may be preferably used. The polyamine raw material may further or optionally comprise ethylenediamine. In view of improvement of the performance of the condensation product or derivative thereof as a dispersant, the content of ethylenediamine in the polyamine raw material is preferably 0 to 10 mass %, and more preferably 0 to 5 mass %, on the basis of the total mass of the polyamine raw material. Succinimide obtained as the condensation reaction product of alkyl- or alkenyl-succinic acid having a C40-400 alkyl or alkenyl group or anhydride thereof, and a mixture of at least two polyamines is a mixture of the compounds of the general formulae (2) or (3) having different values of b or c.

Examples of derivatives (modified compounds) of the foregoing succinimide include:

(i) oxygen-containing organic compound-modified compounds where a part or all of the residual amino and/or imino groups is/are neutralized or amidated by reacting succinimide as described above with a C1-30 monocarboxylic acid such as fatty acids, a C2-30 polycarboxylic acid (such as ethanedioic acid, phthalic acid, trimellitic acid, and pyromellitic acid), an anhydride or ester thereof, a C2-6 alkylene oxide, or a hydroxy(poly)oxyalkylene carbonate;

(ii) boron-modified compounds (boronated succinimide) where a part or all of the residual amino and/or imino groups is/are neutralized or amidated by reacting succinimide as described above with boric acid;

(iii) phosphoric acid-modified compounds where a part or all of the residual amino and/or imino groups is/are neutralized or amidated by reacting succinimide as described above with phosphoric acid;

(iv) sulfur-modified compounds obtained by reacting succinimide as described above with a sulfur compound; and (v) modified compounds obtained by two or more modifications selected from oxygen-containing organic compound-modification, boron-modification, phosphoric acid-modification, and sulfur-modification, on succinimide as described above. Among the derivatives (modified compounds) (i) to (v), a boron-modified compound (boronated succinimide), may be preferably used.

The weight average molecular weight of the succinimide ashless dispersant is preferably 2000 to 20000, more preferably 3000 to 15000, and in one embodiment 4000 to 9000. The weight average molecular weight of the component (B) at the above described lower limit or more can lead to further improved electrical insulation of a fresh oil and the oxidatively deteriorated composition. The weight average molecular weight of the component (B) at the above described upper limit or less can lead to further improved electrical insulation of the oxidatively deteriorated composition.

The content of the component (B) in the lubricating oil composition is 0.005 to 0.25 mass %, and in one embodiment 0.01 to 0.25 mass %, in terms of nitrogen on the basis of the total mass of the lubricating oil composition. The content of the component (B) at the above described upper limit or less can lead to improved electrical insulation of a fresh oil and the oxidatively deteriorated composition. The content of the component (B) at the above described lower limit or more can lead to improved electrical insulation of a fresh oil.

<(C) Nitrogen-Containing Antioxidant>

The lubricating oil composition according to the present invention comprises (C) a nitrogen-containing antioxidant (hereinafter may be referred to as "component (C)"). As the component (C), one compound may be used alone, or at least two compounds may be used in combination. As the component (C), any known amine antioxidant such as aromatic amine antioxidants and hindered amine antioxidants may be used without particular limitations. Examples of aromatic amine antioxidants include primary aromatic amine compounds such as alkylated-α-naphthylamine; and secondary aromatic amine compounds such as alkylated diphenylamine, phenyl-α-naphthylamine, alkylated phenyl-α-naphthylamine, and phenyl-β-naphthylamine. As an aromatic amine antioxidant, alkylated diphenylamine, or alkylated phenyl-α-naphthylamine, or the combination thereof may be preferably used. As the component (C), at least one aromatic amine antioxidant may be used, at least one hindered amine antioxidant may be used, or at least one aromatic amine antioxidant and at least one hindered amine antioxidant may be used in combination.

Examples of alkylated diphenylamine antioxidants include any compound represented by the following general formula (4).

(4)

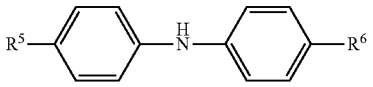

In the general formula (4), $R^5$ and $R^6$ each independently represent a C1-20, preferably a C3-12, more preferably a C4-8 alkyl group. $R^5$ and $R^6$ are preferably different from each other, but it is difficult to synthesize only a compound having a specific combination of $R^5$ and $R^6$. Thus, an alkylated diphenylamine antioxidant represented by the general formula (4) is preferably a mixture of any compound where $R^5$ and $R^6$ are the same, and any compound where $R^5$ and $R^6$ are different from each other.

Examples of alkylated phenyl-α-naphthylamine antioxidants include any compound represented by the following general formula (5).

(5)

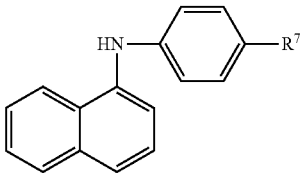

In the general formula (5), $R^7$ represents a C1-16, preferably a C6-20, more preferably a C8-18 alkyl group.

Examples of hindered amine antioxidants include 2,2,6,6-tetraalkylpiperidine derivatives. As a 2,2,6,6-tetraalkylpiperidine derivative, a 2,2,6,6-tetraalkylpiperidine derivative having a substituent in 4-position is preferable. Two 2,2,6,6-tetraalkylpiperidine skeletons may be bonded with each other via substituents in respective 4-positions thereof. There may be no substituent in N-position of the 2,2,6,6-tetraalkylpiperidine skeleton, and a C1-4 alkyl group may be substituted in N-position thereof. The 2,2,6,6-tetraalkylpiperidine skeleton is preferably a 2,2,6,6-tetramethylpiperidine skeleton.

Substituents in 4-position of the 2,2,6,6-tetraalkylpiperidine skeleton include acyloxy group ($R^8COO$—), alkoxy group ($R^8O$—), alkylamino group ($R^8NH$—), and acylamino group ($R^8CONH$—). $R^8$ is preferably a C1-30, more preferably a C1-24, and further preferably a C1-20 hydrocarbon group. Examples of the hydrocarbon group include alkyl group, alkenyl group, cycloalkyl group, alkylcycloalkyl group, aryl group, alkylaryl group, and arylalkyl group.

Examples of substituents when two 2,2,6,6-tetraalkylpiperidine skeletons are bonded with each other via substituents in respective 4-positions thereof include hydrocarbylene bis(carbonyloxy) group (—OOC—$R^9$—COO—), hydrocarbylene diamino group (—HN—$R^9$—NH—), and hydrocarbylene bis(carbonylamino) group (—HNCO—$R^9$—CONH—). $R^9$ is preferably a C1-30 hydrocarbylene group, and is more preferably an alkylene group.

An acyloxy group is preferable as a substituent in 4-position of the 2,2,6,6-tetraalkylpiperidine skeleton. One example of compounds having an acyloxy group in 4-position of the 2,2,6,6-tetraalkylpiperidine skeleton is an ester of 2,2,6,6-tetramethyl-4-piperidinol and a carboxylic acid. Examples of such a carboxylic acid include C8-20 linear or branched chain aliphatic carboxylic acids.

The content of the component (C) in the lubricating oil composition is 0.005 to 0.15 mass %, and in one embodiment may be 0.05 to 0.12 mass %, in terms of nitrogen on the basis of the total mass of the lubricating oil composition. The content of the component (C) at the above described upper limit or less can lead to improved electrical insulation of a fresh oil and the oxidatively deteriorated composition. The content of the component (C) at the above described lower limit or more can lead to improved electrical insulation of the oxidatively deteriorated composition.

<(D) Nitrogen-Containing Friction Modifier>

In one embodiment, the lubricating oil composition may comprise a nitrogen-containing friction modifier (hereinafter may be simply referred to as "component (D)"). Examples of nitrogen-containing friction modifiers include a succinimide friction modifier (D1) described later, and oiliness agent-based friction modifiers such as amine friction modifiers and amide friction modifiers. The component (D) encompasses aliphatic amine compounds each having a C8-36 aliphatic hydrocarbyl group other than the succinimide ashless dispersant (component (B)) and amine antioxidant (component (C)), and compounds each having a C8-36 aliphatic hydrocarbyl or aliphatic hydrocarbylcarbonyl group and an amide bond other than the succinimide ashless dispersant (component (B)) and amine antioxidant (component (C)).

Examples of the amine friction modifier include aliphatic amine compounds each having a C10-30, preferably a C12-24, more preferably a C12-20 alkyl or alkenyl, preferably linear chain alkyl or linear chain alkenyl group.

Examples of the amide friction modifier include condensation products of a linear or branched chain, preferably linear chain fatty acid, and ammonia, an aliphatic monoamine or an aliphatic polyamine.

One example of the amide friction modifier is a fatty acid amide compound having a C10-30, preferably a C12-24 alkylcarbonyl or alkenylcarbonyl group. For example, such an amide compound can be obtained by a condensation reaction of a C10-30, preferably a C12-24 fatty acid or an acid chloride thereof, and an aliphatic primary or secondary amine compound, an aliphatic primary or secondary alkanolamine compound, or ammonia. The foregoing amine compound and alkanolamine compound each preferably have a C1-30, more preferably a C1-10, further preferably a C1-4 aliphatic group, and in one embodiment have a C1 or C2 aliphatic group.

Examples of the fatty acid amide friction modifier include lauramide, myristamide, palmitamide, stearamide, oleamide, cocamide, and C12-13 synthetic mixed fatty acid amide.

Other examples of the amide friction modifier include fatty acid hydrazides, fatty acid semicarbazides, aliphatic ureas, fatty acid ureides, and aliphatic allophanamides each having a C10-30 alkyl or alkenyl group, or a C10-30 alkylcarbonyl or alkenylcarbonyl group, and derivatives (modified compounds) thereof. Examples of the derivative (modified compound) of the amide friction modifier include boric acid-modified compounds obtained by reacting any amide compound as described above with boric acid or a boric acid salt.

Examples of the aliphatic urea friction modifier include aliphatic urea compounds each having a C12-24, preferably a C12-20 alkyl or alkenyl group such as dodecylurea, tridecylurea, tetradecylurea, pentadecylurea, hexadecylurea, heptadecylurea, octadecylurea, and oleylurea, and acid-modified derivatives thereof (acid-modified compounds such as boric acid-modified compounds).

Examples of the fatty acid hydrazide friction modifier include fatty acid hydrazide compounds each having a C12-24 alkylcarbonyl or alkenylcarbonyl group, such as dodecanoic hydrazide, tridecanoic hydrazide, tetradecanoic hydrazide, pentadecanoic hydrazide, hexadecanoic hydrazide, heptadecanoic hydrazide, octadecanoic hydrazide, oleic hydrazide, erucic hydrazide, and acid-modified derivatives thereof (acid-modified compounds such as boric acid-modified compounds).

Other examples of the amide friction modifier include amide compounds of aliphatic hydroxy acids each having a C1-30 hydroxy-substituted alkyl or alkenyl group. Such an amide compound can be obtained by, for example, a condensation reaction of any aliphatic hydroxy acid as described above with an aliphatic primary or secondary amine compound, or an aliphatic primary or secondary alkanolamine compound. The carbon number of a hydroxy-substituted alkyl or alkenyl group of the above described aliphatic hydroxy acid is preferably 1 to 10, more preferably 1 to 4, and in one embodiment 1 or 2. The aliphatic hydroxy acid is preferably a linear chain aliphatic α-hydroxy acid, and in one embodiment is a glycolic acid. The above described amine compounds and alkanolamine compounds each preferably have a C1-30, more preferably a C10-30, further preferably a C12-24, and especially preferably a C12-20 aliphatic group.

Other examples of the amide friction modifier include amide compounds of a C10-30, preferably a C12-24 fatty acid, and an amino acid (N-acylated amino acid). Examples of the N-acylated amino acid friction modifier include N-acylated-N-methylglycine (such as N-oleoyl-N-methylglycine).

((D1) Succinimide Friction Modifier)

In one embodiment, the lubricating oil composition may comprise (D1) a succinimide friction modifier (hereinafter may be referred to as "component (D1)") as the component (D). Examples of the component (D1) include bis-succinimide compounds and mono-succinimide compounds each having a C8-36 alkyl or alkenyl group, and derivatives (modified compounds) thereof. For example, such a succinimide compound is represented by the following general formula (6) or (7).

(6)

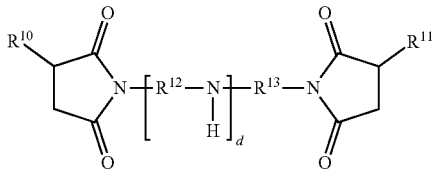

-continued (7)

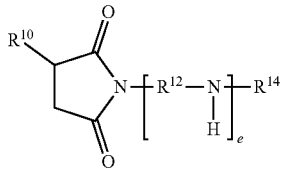

In the general formulae (6) and (7), $R^{10}$ and $R^{11}$ each independently represent a C8-36, preferably a C8-30, more preferably a C12-22, and in one embodiment a C12-18 alkyl or alkenyl group. $R^{12}$ and $R^{13}$ each independently represent a C1-4, preferably a C2-3 alkylene group, and especially preferably an ethylene group. $R^{14}$ is a hydrogen atom or C1-36 alkyl or alkenyl group, preferably a hydrogen atom or C1-30 alkyl or alkenyl group, and more preferably a hydrogen atom. d represents an integer of 1-7, preferably 1-4, more preferably 1-3. e represents an integer of 1-7, preferably 1-5, more preferably 2-5, further preferably 2-4.

A method for producing a succinimide compound that may be used as the component (D1) is not specifically limited. For example, such a succinimide compound may be obtained as a condensation reaction product by: reaction of alkyl- or alkenyl-succinic acid having a C8-36, preferably a C8-30, preferably a C12-22 alkyl or alkenyl group or anhydride thereof, with a polyamine, a N-mono-C1-36 alkylated product of the polyamine or a N-mono-C1-36 alkenylated product of the polyamine, or a mixture thereof. As the component (D1), such a condensation product may be used as it is, and may be converted into a derivative (modified compound) described later to be used. The condensation product of alkyl- or alkenyl-succinic acid or anhydride thereof, and a polyamine may be bistype succinimide where both terminals of a polyamine chain are imidated (see the general formula (6)), may be monotype succinimide where only one end of a polyamine chain is imidated (see the general formula (7)), or may be a mixture thereof. Here, examples of polyamines include diethylenetriamine, triethylenetetramine, tetraethylenepentamine, and pentaethylenehexamine, and any mixtures thereof, and a polyamine raw material comprising at least one selected therefrom may be preferably used. The polyamine raw material may further or optionally comprise ethylenediamine. In view of improvement of the performance of the condensation product or derivative thereof as a friction modifier, the content of ethylenediamine in the polyamine raw material is preferably 0 to 10 mass %, and more preferably 0 to 5 mass %, on the basis of the total mass of the polyamine raw material. As the N-mono-C1-36 alkylated product of the polyamine, a N-mono-C1-36 alkylated polyamine having a C1-36 alkyl group on a nitrogen atom at an end of a chain of the polyamine may be preferably used. As the N-mono-C1-36 alkenylated product of the polyamine, a N-mono-C1-36 alkenylated polyamine having a C1-36 alkenyl group on a nitrogen atom at an end of a chain of the polyamine may be preferably used. In the present description, "Ci-j" (i and j are integers) means that the carbon number is no less than i and no more than j.

Examples of derivatives (modified compounds) of succinimide compounds which may be used as the component (D1) include modified compounds obtained by reacting any succinimide compound as described above with at least one selected from boric acid, phosphoric acid, a C1-20 carboxylic acid, and a sulfur-containing compound. Among them, a boric acid-modified compound may be preferably used.

The lubricating oil composition may optionally comprise the component (D). The content of the component (D) in the lubricating oil composition is 0 to 0.03 mass %, and in one embodiment 0 to 0.02 mass %, in terms of nitrogen on the basis of the total mass of the composition. The content of the component (D) at the above described upper limit or less can lead to improved electrical insulation of a fresh oil and the oxidatively deteriorated composition.

When the lubricating oil composition comprises the component (D1) as the component (D), the content of the component (D1) in the lubricating oil composition is preferably 0.001 to 0.03 mass %; and may be 0.001 to 0.02 mass % in one embodiment, and may be 0.001 to 0.01 mass % in another embodiment, in terms of nitrogen on the basis of the total mass of the composition. The content of the component (D1) at the above described upper limit or less can lead to further improved electrical insulation of a fresh oil and the oxidatively deteriorated composition. The content of the component (D1) at the above described lower limit or more can lead to a reduced friction coefficient for a long term. In the present description, the content of the component (D1) shall contribute to the content of the component (D).

<(E) Phosphite Ester Compound>

In one preferred embodiment, the lubricating oil composition may further comprise a phosphite ester compound (hereinafter may be referred to as "component (E)") represented by the following general formula (8). As the component (E), one phosphite ester compound may be used alone, or at least two phosphite ester compounds may be used in combination.

(8)

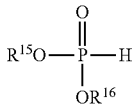

In the general formula (8), $R^{15}$ and $R^{16}$ are each independently a C1-18 linear chain hydrocarbon group, or any C5-20 group represented by the following general formula (9).

(9)

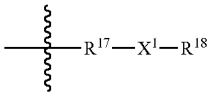

In the general formula (9), $R^{17}$ is a C2-17 linear chain hydrocarbon group, preferably an ethylene group or a propylene group, and in one embodiment, an ethylene group; $R^{18}$ is a C3-17, preferably a C3-16, and especially preferably a C6-10 linear chain hydrocarbon group. $X^1$ is an oxygen atom or a sulfur atom, preferably a sulfur atom.

Using a phosphite ester compound having the foregoing structure as the component (E) can lead to further improved anti-wear performance and anti-fatigue performance.

In one embodiment, preferred examples of $R^{15}$ and $R^{16}$ include C4-18 linear chain alkyl groups. Examples of the linear chain alkyl group include butyl group, pentyl group, hexyl group, heptyl group, octyl group, nonyl group, decyl group, undecyl group, dodecyl group, tridecyl group, tetradecyl group, pentadecyl group, hexadecyl group, heptadecyl group, and octadecyl group.

In one embodiment, preferred examples of $R^{15}$ and $R^{16}$ include 3-thiahexyl group, 3-thiaheptyl group, 3-thiaoctyl group, 3-thianonyl group, 3-thiadecyl group, 3-thiaundecyl group, 4-thiahexyl group, 3-oxapentyl group, 3-oxahexyl group, 3-oxaheptyl group, 3-oxaoctyl group, 3-oxanonyl group, 3-oxadecyl group, 3-oxaundecyl group, 3-oxadodecyl group, 3-oxatridecyl group, 3-oxatetradecyl group, 3-oxapentadecyl group, 3-oxahexadecyl group, 3-oxaheptadecyl group, 3-oxaheptadecyl group, 3-oxanonadecyl group, 4-oxahexyl group, 4-oxaheptyl group, and 4-oxaoctyl group.

The lubricating oil composition may optionally comprise the component (E). When the lubricating oil composition comprises the component (E), the content of the component (E) in the lubricating oil composition is preferably 0.01 to 0.06 mass % in terms of phosphorus on the basis of the total mass of the composition. The content of the component (E) at the above described upper limit or less can lead to further improved electrical insulation of a fresh oil and the oxidatively deteriorated composition. The content of the component (E) at the above described lower limit or more can lead to further improved anti-wear performance and anti-fatigue performance.

<(F) Triazole Metal Deactivator>

In one preferred embodiment, the lubricating oil composition may further comprise a tolyltriazole metal deactivator and/or a benzotriazol metal deactivator (hereinafter may be referred to as "component (F)"). As the component (F), any tolyltriazole metal deactivator and/or benzotriazol metal deactivator used in lubricating oils may be used without particular limitations. As the component (F), one compound may be used alone, or at least two compounds may be used in combination.

The lubricating oil composition may optionally comprise the component (F). When the lubricating oil composition comprises the component (F), the content of the component (F) is preferably 0.001 to 0.1 mass %, more preferably 0.001 to 0.075 mass %, and especially preferably 0.001 to 0.05 mass %. The content of the component (F) at the above described lower limit or more can lead to further improved copper corrosion inhibition performance. The content of the component (F) at the above described upper limit or less can lead to further improved anti-wear performance, and electrical insulation of a fresh oil and the oxidatively deteriorated composition.

<Other Additives>

In one embodiment, the lubricating oil composition may further comprise at least one additive selected from viscosity index improvers, pour point depressants, antioxidants other than the component (C), anti-wear agents or extreme-pressure agents other than component (E), friction modifiers other than the component (D), corrosion inhibitors other than the component (F), metal deactivators other than the component (F), anti-rust agents, demulsifiers, anti-foaming agents, and coloring agents.

As a viscosity index improver, any viscosity index improver that is used in lubricating oils may be used without particular limitations. Examples of such a viscosity index improver include polymethacrylates, ethylene-α-olefin copolymers and hydrogenated products thereof, copolymers of an α-olefin and an ester monomer having a polymerizable unsaturated bond, polyisobutylene and hydrogenated products thereof, hydrogenated products of styrene-diene copolymers, styrene-maleic anhydride/ester copolymers, and polyalkylstyrene. Among them, a polymethacrylate, an ethylene-α-olefin copolymer or a hydrogenated product thereof, or any combination thereof may be preferably used. The viscosity index improver may be dispersant type, or may be non-dispersant type. In one embodiment, the weight average molecular weight of the viscosity index improver may be, for example, 2000 to 30000. The lubricating oil composition may optionally comprise the viscosity index improver. When the lubricating oil composition comprises the viscosity index improver, the content of the viscosity index improver is preferably no more than 12 mass %, and more preferably no more than 8 mass %, on the basis of the total mass of the composition. The content of the viscosity index improver at the foregoing upper limit or less can lead to further improved electrical insulation of a fresh oil and the oxidatively deteriorated composition. The lower limit of this content is not particularly limited, but in one embodiment may be no less than 1 mass %.

As a pour point depressant, for example, any known pour point depressant such as a polymethacrylate polymer may be used without particular limitations. The lubricating oil composition may optionally comprise the pour point depressant. When the lubricating oil composition comprises the pour point depressant, the content of the pour point depressant is preferably no more than 1 mass %, and more preferably no more than 0.5 mass %, on the basis of the total mass of the composition. The content of the pour point depressant at the above described upper limit or less can lead to further improved electrical insulation of a fresh oil and the oxidatively deteriorated composition. The lower limit of this content is not particularly restricted, but in one embodiment may be no less than 0.1 mass %.

As an antioxidant other than the component (C), a known antioxidant such as a phenolic antioxidant which does not fall under the component (C) may be used without any particular limitations. Examples of the phenolic antioxidant include 4,4'-methylenebis(2,6-di-tert-butylphenol); 4,4'-bis(2,6-di-tert-butylphenol); 4,4'-bis(2-methyl-6-tert-butylphenol); 2,2'-methylenebis(4-ethyl-6-tert-butylphenol); 2,2'-methylenebis(4-methyl-6-tert-butylphenol); 4,4'-butylidenebis(3-methyl-6-tert-butylphenol); 4,4'-isopropylidenebis(2,6-di-tert-butylphenol); 2,2'-methylenebis(4-methyl-6-nonylphenol); 2,2'-isobutylidenebis(4,6-dimethylphenol); 2,2'-methylenebis(4-methyl-6-cyclohexylphenol); 2,6-di-tert-butyl-4-methylphenol; 2,6-di-tert-butyl-4-ethylphenol; 2,4-dimethyl-6-tert-butylphenol; 2,6-di-tert-butyl-4-(N,N'-dimethylaminomethyl)phenol; 4,4'-thiobis(2-methyl-6-tert-butylphenol); 4,4'-thiobis(3-methyl-6-tert-butylphenol); 2,2'-thiobis(4-methyl-6-tert-butylphenol); bis(3-methyl-4-hydroxy-5-tert-butylbenzyl) sulfide; bis(3,5-di-tert-butyl-4-hydroxybenzyl) sulfide; bis (3,5-di-tert-4-hydroxybenzyl) sulfide; 2,2'-thiodiethylene bis[3-(3,5-di-tert-butyl-4-hydroxyphenyl)propionate]; tridecyl-3-(3,5-di-tert-butyl-4-hydroxyphenyl)propionate; pentaerythritol tetrakis[3-(3,5-di-tert-butyl-4-hydroxyphenyl)propionate]; octyl 3-(3,5-di-tert-butyl-4-hydroxyphenyl)propionate; octadecyl 3-(3,5-di-tert-butyl-4-hydroxyphenyl)propionate; and 3-methyl-5-tert-butyl-4-hydroxyphenol fatty acid esters.

The lubricating oil composition may optionally comprise an antioxidant other than the component (C). When the lubricating oil composition comprises an antioxidant other than the component (C), the content of this antioxidant is preferably 0.1 to 1.5 mass %, and more preferably 0.1 to 1.0 mass %, on the basis of the total mass of the composition. The content of this antioxidant at the above described upper limit or less can lead to further improved electrical insulation of a fresh oil and the oxidatively deteriorated composition. The content of this antioxidant at the above described upper limit or less can also lead to improved oxidation stability of the lubricating oil composition.

Examples of an anti-wear agent or extreme-pressure agent other than component (E) include sulfur-containing compounds such as disulfides, sulfurized olefins, sulfurized oils, and dithiocarbamates, and phosphorus-containing anti-wear agents other than the component (E). Examples of phosphorus-containing anti-wear agents other than the component (E) include phosphoric acid, thiophosphoric acid, dithiophosphoric acid, trithiophosphoric acid, and complete or partial esters thereof; phosphorous acid, thiophosphoric acid, dithiophosphoric acid, trithiophosphoric acid, monoesters thereof, diesters thereof (excluding diesters represented by the general formula (8)), and triesters thereof. The lubricating oil composition may optionally comprise an anti-wear agent other than the component (E). When the lubricating oil composition comprises an anti-wear agent other than the component (E), the content of this anti-wear agent is preferably no more than 10 mass %, and more preferably no more than 5 mass %, on the basis of the total mass of the composition. The content of this anti-wear agent at the above described upper limit or less can lead to further improved electrical insulation of a fresh oil and the oxidatively deteriorated composition. The lower limit of this content is not particularly restricted, but in one embodiment, may be no less than 1 mass %.

The lubricating oil composition may optionally comprise a phosphorus-containing additive other than the component (E). The total phosphorus content in the lubricating oil composition is preferably no more than 0.06 mass % on the basis of the total mass of the composition. The total phosphorus content in the lubricating oil composition at the above described upper limit or less can lead to further improved electrical insulation of a fresh oil and the oxidatively deteriorated composition. In one embodiment, the total content of a phosphorus-containing additive other than the component (E) in the lubricating oil composition is preferably 0 to 0.05 mass %, more preferably 0 to 0.03 mass %, and further preferably 0 to 0.02 mass %, in terms of phosphorus on the basis of the total mass of the composition. The total content of a phosphorus-containing additive other than the component (E) at the above described upper limit or less can lead to further improved electrical insulation of a fresh oil and the oxidatively deteriorated composition.

As a friction modifier other than the component (D), for example, at least one friction modifier selected from organic molybdenum compounds and oiliness agent-based friction modifiers other than the component (D) may be used. The lubricating oil composition may optionally comprise a friction modifier other than the component (D). When the lubricating oil composition comprises a friction modifier other than the component (D), the content of this friction modifier is preferably no more than 1.0 mass %, and more preferably no more than 0.5 mass %, on the basis of the total mass of the composition. The content of this friction modifier at the above described upper limit or less can lead to further improved electrical insulation of a fresh oil and the oxidatively deteriorated composition.

Examples of organic molybdenum compounds include sulfur-containing organic molybdenum compounds, and organic molybdenum compounds which do not contain sulfur as a constituent element. Examples of the sulfur-containing organic molybdenum compound include sulfur-containing organic compounds such as molybdenum dithiocarbamate compounds; molybdenum dithiophosphate compounds; complexes of molybdenum compounds (examples thereof include: molybdenum oxides such as molybdenum dioxide and molybdenum trioxide; molybdenum acids such as orthomolybdic acid, paramolybdic acid, and sulfurized (poly)molybdic acid; molybdic acid salts such as metal salts and ammonium salts of these molybdic acids; molybdenum sulfides such as molybdenum disulfide, molybdenum trisulfide, molybdenum pentasulfide, and molybdenum polysulfide; thiomolybdic acid; metal salts and amine salts of thiomolybdic acid; and molybdenum halides such as molybdenum chloride), and sulfur-containing organic compounds (examples thereof include: alkyl (thio) xanthate, thiadiazole, mercaptothiadiazole, thiocarbonate, tetrahydrocarbylthiuram disulfide, bis(di(thio)hydrocarbyl dithiophosphonate) disulfide, organic (poly)sulfide, and sulfurized ester) or other organic compounds; and sulfur-containing organic molybdenum compounds such as complexes of sulfur-containing molybdenum compounds such as the above described molybdenum sulfides and sulfurized molybdic acids, and alkenylsuccinimide. The organic molybdenum compound may be a mononuclear molybdenum compound, or may be a polynuclear molybdenum compound such as binuclear molybdenum compounds and trinuclear molybdenum compounds. Examples of the organic molybdenum compound which does not contain sulfur as a constituent element include molybdenum-amine complexes, molybdenum-succinimide complexes, molybdenum salts of organic acids, and molybdenum salts of alcohols.

The lubricating oil composition may optionally comprise a metal-containing additive other than the metallic detergent (such as organic molybdenum compounds and zinc dialkyl dithiophosphate). The total content of metal elements in the lubricating oil composition is preferably no more than 0.03 mass % in terms of metal on the basis of the total mass of the composition. The total content of metal elements in the lubricating oil composition at the above described upper limit or less can lead to further improved electrical insulation of a fresh oil and the oxidatively deteriorated composition. In one embodiment, the total content of a metal-containing additive other than the metallic detergent in the lubricating oil composition is preferably no more than 0.010 mass %, more preferably no more than 0.0075 mass %, and further preferably no more than 0.0050 mass %, in terms of metal on the basis of the total mass of the composition. The total content of a metal-containing additive other than the metallic detergent at the above described upper limit or less can lead to further improved electrical insulation of a fresh oil and the oxidatively deteriorated composition.

Examples of oiliness agent-based friction modifiers other than the component (D) include compounds such as fatty acid esters, fatty acids, fatty acid metal salts, aliphatic alcohols, and aliphatic ethers. These compounds each preferably have a C10-30 aliphatic hydrocarbyl or aliphatic hydrocarbylcarbonyl group, more preferably a C10-30 alkyl or alkenyl group or a C10-30 alkylcarbonyl or alkenylcarbonyl group, further preferably a C10-30 linear chain alkyl or linear chain alkenyl group or a C10-30 linear chain alkylcarbonyl or linear chain alkenylcarbonyl group.

As a corrosion inhibitor other than the component (F), for example, any known corrosion inhibitor such as thiadiazole compounds and imidazole compounds may be used without particular limitations. The lubricating oil composition may optionally comprise a corrosion inhibitor other than the component (F). When the lubricating oil composition comprises a corrosion inhibitor other than the component (F), the content of this corrosion inhibitor is preferably no more than 1 mass %, and more preferably no more than 0.5 mass %, on the basis of the total mass of the composition. The content of this corrosion inhibitor at the above described upper limit or less can lead to further improved electrical insulation of a fresh oil and the oxidatively deteriorated composition. The lower limit of the content of this corrosion inhibitor is not particularly restricted, but in one embodiment may be no less than 0.01 mass %.

As a metal deactivator other than the component (F), for example, any known metal deactivator such as imidazoline, pyrimidine derivatives, alkylthiadiazoles, mercaptobenzothiazoles, 1,3,4-thiadiazole polysulfide, 1,3,4-thiadiazolyl-2,5-bis(dialkyl dithiocarbamate), 2-(alkyldithio)benzimidazole, and β-(o-carboxybenzylthio)propionitrile may be used without particular limitations. The lubricating oil composition may optionally comprise a metal deactivator other than the component (F). When the lubricating oil composition comprises a metal deactivator other than the component (F), the content of this metal deactivator is preferably no more than 1 mass %, and more preferably no more than 0.5 mass %, on the basis of the total mass of the composition. The content of this metal deactivator at the above described upper limit or less can lead to further improved electrical insulation of a fresh oil and the oxidatively deteriorated composition. The lower limit of the content of this metal deactivator is not particularly restricted, but in one embodiment may be no less than 0.01 mass %.

As an anti-rust agent, for example, any known anti-rust agent such as petroleum sulfonate, alkylbenzenesulfonate, dinonylnaphthalenesulfonate, alkenylsuccinate esters, and polyol esters may be used without particular limitations. The lubricating oil composition may optionally comprise an anti-rust agent. When the lubricating oil composition comprises an anti-rust agent, the content of this anti-rust agent is preferably no more than 1 mass %, and more preferably no more than 0.5 mass %, on the basis of the total mass of the composition. The content of this anti-rust agent at the above described upper limit or less can lead to further improved electrical insulation of a fresh oil and the oxidatively deteriorated composition. The lower limit of the content of this anti-rust agent is not particularly restricted, but in one embodiment may be no less than 0.01 mass %. In the present description, the content of any metal sulfonate shall contribute to the content of the metallic detergent even when used as an anti-rust agent.

As a demulsifier, for example, any known demulsifier such as polyoxyalkylene glycol-based nonionic surfactants including polyoxyethylene alkyl ether, polyoxyethylene alkylphenyl ether, and polyoxyethylene alkylnaphthyl ether may be used without particular limitations. The lubricating oil composition may optionally comprise a demulsifier. When the lubricating oil composition comprises a demulsifier, the content of this demulsifier is preferably no more than 5 mass %, and more preferably no more than 3 mass %, on the basis of the total mass of the composition. The content of this demulsifier at the above described upper limit or less can lead to further improved electrical insulation of a fresh oil and the oxidatively deteriorated composition. The lower limit of this content is not particularly restricted, but in one embodiment may be no less than 1 mass %.

As an anti-foaming agent, any known anti-foaming agent such as silicones, fluorosilicones, and fluoroalkyl ethers may be used. The lubricating oil composition may optionally comprise an anti-foaming agent. When the lubricating oil composition comprises an anti-foaming agent, the content of this anti-foaming agent is preferably no more than 0.5 mass %, and more preferably no more than 0.1 mass %. The content of this anti-foaming agent at the above described upper limit or less can lead to further improved electrical insulation of a fresh oil and the oxidatively deteriorated composition. The lower limit of this content is not particularly restricted, but in one embodiment may be no less than 0.0001 mass %.

As a coloring agent, for example, any known coloring agent such as azo compounds may be used.

<Lubricating Oil Composition>

The kinematic viscosity of the lubricating oil composition at 100° C. is preferably 1.8 to 4.0 $mm^2/s$. The kinematic viscosity of the composition at 100° C. at the above described upper limit or less can lead to improved fuel efficiency. The kinematic viscosity of the composition at 100° C. at the above described lower limit or more can lead to further improved anti-seizure performance, anti-wear performance, anti-fatigue performance, and electrical insulation of a fresh oil and the oxidatively deteriorated composition.

The kinematic viscosity of the lubricating oil composition at 40° C. is preferably 4 to 20 $mm^2/s$. The kinematic viscosity of the composition at 40° C. at the above described upper limit or less can lead to improved fuel efficiency. The kinematic viscosity of the composition at 40° C. at the above described lower limit or more can lead to further improved anti-seizure performance, anti-wear performance, anti-fatigue performance, and electrical insulation of a fresh oil and the oxidatively deteriorated composition.

In one embodiment, the volume resistivity of an oxidatively deteriorated oil of the lubricating oil composition at 80° C. is preferably no less than $1.0\times10^9$ Ω·cm. In the present description, the volume resistivity of an oxidatively deteriorated oil is volume resistivity of an oxidatively deteriorated oil measured at 80° C. in oil temperature, conforming to the volume resistivity test specified in JIS C2101: this oxidatively deteriorated oil is obtained by oxidation treatment on a fresh oil at 165° C. for 150 hours by the ISOT method (Indiana Stirring Oxidation Test) specified in JIS K2514-1.

In one embodiment, the total content of any compound having a non-phenolic OH group (which may be part of any other functional group (such as carboxy group and phosphoric acid group)) or a salt thereof, >NH group, or —$NH_2$ group (hereinafter may be referred to as "O/N-based active hydrogen-containing group"), and not contributing to any content of the metallic detergent, the succinimide ashless dispersant, the amine antioxidant, the succinimide friction modifier (the component (D1)), a phosphite diester compound that does not have an O/N-based active hydrogen-containing group in its alcohol residue (such as the component (E)), and the tolyltriazole metal deactivator may be preferably 0 to 500 mass ppm, in one embodiment 0 to 300 mass ppm, and in another embodiment 0 to 150 mass ppm, on the basis of the total mass of the lubricating oil composition in terms of the sum of the oxygen element content and the nitrogen element content. Examples of such an O/N-based active hydrogen compound include phosphoric acid (which may be in a form of a salt) and partial esters thereof; phosphorous acid (which may be in a form of a salt) and partial esters thereof (it is noted that any phosphite diester compound that does not have the above described O/N-based active hydrogen-containing group in its alcohol residue shall not fall under the O/N-based active hydrogen compound); nitrogen-containing oiliness agent-based friction modifiers each having a N—H bond (such as primary fatty amines, secondary fatty amines, fatty acid primary amides, fatty acid secondary amides, aliphatic ureas each having a N—H bond, and fatty acid hydrazides); nitrogen-containing oiliness agent-based friction modifiers each having a hydroxy group (such as amides of fatty acids and primary or secondary alkanolamines, and amides of primary or secondary fatty amines and aliphatic hydroxy acids); nitrogen-containing oiliness agent-based friction modifiers each having a carboxy group (which may be in a form of a salt) (such as N-acylated amino acids); oiliness agent-based friction modifiers each having a hydroxy group (such as glycerol monooleate), and oiliness agent-based friction modifiers each having a carboxy group (which may be in a form of a salt) (such as fatty acids and fatty acid metal salts). When one O/N-based active hydrogen compound comprises both an oxygen element and a nitrogen element, the amounts of both an oxygen element and a nitrogen element derived from this compound shall contribute to the total content of the O/N-based active hydrogen compound (total amount of oxygen and nitrogen elements) irrespective of whether each oxygen atom of the compound is bonded to a hydrogen atom and irrespective of whether each nitrogen atom of the compound is bonded to a hydrogen atom. The total content of the O/N-based active hydrogen compound at the above described upper limit or less can lead to further improved electrical insulation of a fresh oil and the oxidatively deteriorated oil.

(Use)

The lubricating oil composition according to the present invention has balanced anti-fatigue performance and electrical insulation of the oxidatively deteriorated composition, and thus may be preferably used as an electric motor oil, a transmission oil, a common lubricating oil for electric motors and transmissions (gear mechanisms), or a lubricating oil for electric drive modules including an electric motor and a transmission (gear mechanism). In one embodiment, the lubricating oil composition according to the present invention may be preferably used for lubrication of electric motors in automobiles including the electric motor. In another embodiment, the lubricating oil composition according to the present invention may be preferably used for lubrication of electric motors and transmissions (gear mechanism) in automobiles including the electric motor and the transmission (gear mechanism).

EXAMPLES

Hereinafter, the present invention will be further specifically described based on examples and comparative examples. The present invention is not limited to these examples.

Examples 1 to 27 and Comparative Examples 1 to 5

As shown in tables 1 to 6, lubricating oil compositions according to the present invention (examples 1 to 27), and lubricating oil compositions for comparison (comparative examples 1 to 5) were each prepared. In the tables, "mass %" for the base oil means mass % on the basis of the total mass of the base oils (the total mass of the base oils is defined as 100 mass %), "mass %" for the other components means mass % on the basis of the total mass of the composition (the total mass of the composition is defined as 100 mass %), and "mass ppm" for the other components means mass ppm on the basis of the total mass of the composition. Details of the components are as follows.

(Lubricating Base Oil)

O-1: hydrorefined mineral oil (Group II, kinematic viscosity (40° C.): 7.7 $mm^2/s$, kinematic viscosity (100° C.): 2.3 $mm^2/s$, viscosity index: 118, sulfur content: less than 1 mass ppm)

O-2: hydrorefined mineral oil (Group III, kinematic viscosity (40° C.): 19.5 $mm^2/s$, kinematic viscosity (100° C.): 4.2 $mm^2/s$, viscosity index: 125, sulfur content: less than 1 mass ppm)

O-3: wax isomerized base oil (Group III, kinematic viscosity (40° C.): 9.3 $mm^2/s$, kinematic viscosity (100° C.): 2.7 $mm^2/s$, viscosity index: 125, sulfur content: less than 1 mass ppm)

O-4: wax isomerized base oil (Group III, kinematic viscosity (40° C.): 15.7 $mm^2/s$, kinematic viscosity (100° C.): 3.8 $mm^2/s$, viscosity index: 143, sulfur content: less than 1 mass ppm)

O-5: poly-α-olefin (Group IV, kinematic viscosity (40° C.): 5.0 $mm^2/s$, kinematic viscosity (100° C.): 1.7 $mm^2/s$)

O-6: poly-α-olefin (Group IV, kinematic viscosity (40° C.): 18.4 $mm^2/s$, kinematic viscosity (100° C.): 4.1 $mm^2/s$, viscosity index: 124)

O-7: monoester base oil (Group V, kinematic viscosity (40° C.): 8.5 $mm^2/s$, kinematic viscosity (100° C.): 2.7 $mm^2/s$, viscosity index: 177)

((A) Calcium Detergent)

A-1: calcium salicylate detergent, base number: 325 mgKOH/g

A-2*: calcium sulfonate detergent, base number: 300 mgKOH/g

<(B) Succinimide Ashless Dispersant>

B-1: non-boronated succinimide ashless dispersant (weight average molecular weight: 9000)

B-2: boronated succinimide ashless dispersant (weight average molecular weight: 6000)

((C) Nitrogen-Containing Antioxidant)

C-1: aromatic amine antioxidant

C-2: hindered amine antioxidant ((D) Succinimide Friction Modifier)

D-1: succinimide friction modifier (in the general formula (6), $R^{10}$=$R^{11}$=an octadecenyl group, $R^{12}$=$R^{13}$=an ethylene group, d=1)

((E) Phosphite Ester)

E-1: bis(3-thiaundecyl) hydrogen phosphite ((F) Triazole Metal Deactivator)

F-1: tolyltriazole metal deactivator ((G) Other Antioxidants)

G-1: phenolic antioxidant

TABLE 1

| | | examples | | | | | |
|---|---|---|---|---|---|---|---|
| | | 1 | 2 | 3 | 4 | 5 | 6 |
| base oil composition | | | | | | | |
| O-1 | mass % | 85 | 60 | — | — | — | 75 |
| O-2 | mass % | 15 | — | 50 | — | — | 15 |
| O-3 | mass % | — | 40 | — | — | — | — |
| O-4 | mass % | — | — | — | 55 | — | — |

TABLE 1-continued

| | | examples | | | | | |
|---|---|---|---|---|---|---|---|
| | | 1 | 2 | 3 | 4 | 5 | 6 |
| O-5 | mass % | — | — | 50 | 45 | 50 | — |
| O-6 | mass % | — | — | — | — | 50 | — |
| O-7 | mass % | — | — | — | — | — | 10 |
| kinematic viscosity of base oil | | | | | | | |
| 40° C. | $mm^2/s$ | 8.7 | 8.6 | 9.1 | 8.9 | 8.9 | 8.8 |
| 100° C. | $mm^2/s$ | 2.5 | 2.5 | 2.5 | 2.5 | 2.5 | 2.5 |
| (A) Ca detergent | | | | | | | |
| A-1 | mass % (Ca) | 0.015 | 0.015 | 0.015 | 0.015 | 0.015 | 0.015 |
| A-2* | mass % (Ca) | — | — | — | — | — | — |
| salicylates in soap groups | mol % | 100 | 100 | 100 | 100 | 100 | 100 |
| (B) ashless dispersant | | | | | | | |
| B-1 | mass % (N) | 0.050 | 0.050 | 0.050 | 0.050 | 0.050 | 0.050 |
| B-2 | mass % (N) | — | — | — | — | — | — |
| (C) antioxidant | | | | | | | |
| C-1 | mass % (N) | 0.02 | 0.02 | 0.02 | 0.02 | 0.02 | 0.02 |
| C-2 | mass % (N) | — | — | — | — | — | — |
| (D) friction modifier | | | | | | | |
| D-1 | mass % (N) | — | — | — | — | — | — |
| (E) phosphite ester | | | | | | | |
| E-1 | mass % (P) | 0.035 | 0.035 | 0.035 | 0.035 | 0.035 | 0.035 |
| (F) metal deactivator | | | | | | | |
| F-1 | mass % | 0.05 | 0.05 | 0.05 | 0.05 | 0.05 | 0.05 |
| (G) other antioxidants | | | | | | | |
| G-1 | mass % | 0.5 | 0.5 | 0.5 | 0.5 | 0.5 | 0.5 |
| kinematic viscosity of composition | | | | | | | |
| 40° C. | $mm^2/s$ | 9.7 | 9.1 | 10.5 | 10.1 | 10.2 | 9.6 |
| 100° C. | $mm^2/s$ | 2.7 | 2.6 | 2.8 | 2.8 | 2.8 | 2.7 |
| viscosity index | | 131 | 121 | 114 | 125 | 116 | 116 |
| volume resistivity (80° C.) | | | | | | | |
| fresh oil | $10^{10}\Omega \cdot cm$ | 0.34 | 0.34 | 0.34 | 0.34 | 0.34 | 0.35 |
| oxidatively deteriorated oil | $10^{10}\Omega \cdot cm$ | 0.21 | 0.21 | 0.21 | 0.21 | 0.21 | 0.20 |
| Unisteel test | | | | | | | |
| fatigue life L50 | h | 20 | 20 | 20 | 20 | 20 | 20 |

TABLE 2

| | | examples | | | | | |
|---|---|---|---|---|---|---|---|
| | | 7 | 8 | 9 | 10 | 11 | 12 |
| base oil composition | | | | | | | |
| O-1 | mass % | — | 50 | 27 | 85 | 85 | 85 |
| O-2 | mass % | — | 50 | 73 | 15 | 15 | 15 |
| O-3 | mass % | — | — | — | — | — | — |
| O-4 | mass % | — | — | — | — | — | — |
| O-5 | mass % | 100 | — | — | — | — | — |
| O-6 | mass % | — | — | — | — | — | — |
| O-7 | mass % | — | — | — | — | — | — |
| kinematic viscosity of base oil | | | | | | | |
| 40° C. | $mm^2/s$ | 5.0 | 11.8 | 14.7 | 8.7 | 8.7 | 8.7 |
| 100° C. | $mm^2/s$ | 1.7 | 3.0 | 3.5 | 2.5 | 2.5 | 2.5 |
| (A) Ca detergent | | | | | | | |
| A-1 | mass % (Ca) | 0.015 | 0.015 | 0.015 | 0.005 | 0.01 | 0.03 |
| A-2* | mass % (Ca) | — | — | — | — | — | — |
| salicylates in soap groups | mol % | 100 | 100 | 100 | 100 | 100 | 100 |
| (B) ashless dispersant | | | | | | | |
| B-1 | mass % (N) | 0.050 | 0.050 | 0.050 | 0.050 | 0.050 | 0.050 |
| B-2 | mass % (N) | — | — | — | — | — | — |

TABLE 2-continued

| | | examples | | | | | |
|---|---|---|---|---|---|---|---|
| | | 7 | 8 | 9 | 10 | 11 | 12 |
| (C) antioxidant | | | | | | | |
| C-1 | mass % (N) | 0.02 | 0.02 | 0.02 | 0.02 | 0.02 | 0.02 |
| C-2 | mass % (N) | — | — | — | — | — | — |
| (D) friction modifier | | | | | | | |
| D-1 | mass % (N) | — | — | — | — | — | — |
| (E) phosphite ester | | | | | | | |
| E-1 | mass % (P) | 0.035 | 0.035 | 0.035 | 0.035 | 0.035 | 0.035 |
| (F) metal deactivator | | | | | | | |
| F-1 | mass % | 0.05 | 0.05 | 0.05 | 0.05 | 0.05 | 0.05 |
| (G) other antioxidants | | | | | | | |
| G-1 | mass % | 0.5 | 0.5 | 0.5 | 0.5 | 0.5 | 0.5 |
| kinematic viscosity of composition | | | | | | | |
| 40° C. | $mm^2/s$ | 5.7 | 13.1 | 16.1 | 9.7 | 9.7 | 9.7 |
| 100° C. | $mm^2/s$ | 1.9 | 3.3 | 3.8 | 2.7 | 2.7 | 2.7 |
| viscosity index | | 114 | 124 | 126 | 131 | 131 | 131 |
| volume resistivity (80° C.) | | | | | | | |
| fresh oil | $10^{10}\Omega \cdot cm$ | 0.27 | 0.40 | 0.45 | 0.40 | 0.36 | 0.28 |
| oxidatively deteriorated oil | $10^{10}\Omega \cdot cm$ | 0.15 | 0.27 | 0.31 | 0.17 | 0.22 | 0.19 |
| Unisteel test | | | | | | | |
| fatigue life L50 | h | 18 | 21 | 21 | 20 | 20 | 20 |

TABLE 3

| | | examples | | | | | |
|---|---|---|---|---|---|---|---|
| | | 13 | 14 | 15 | 16 | 17 | 18 |
| base oil composition | | | | | | | |
| O-1 | mass % | 85 | 85 | 85 | 85 | 85 | 85 |
| O-2 | mass % | 15 | 15 | 15 | 15 | 15 | 15 |
| O-3 | mass % | — | — | — | — | — | — |
| O-4 | mass % | — | — | — | — | — | — |
| O-5 | mass % | — | — | — | — | — | — |
| O-6 | mass % | — | — | — | — | — | — |
| O-7 | mass % | — | — | — | — | — | — |
| kinematic viscosity of base oil | | | | | | | |
| 40° C. | $mm^2/s$ | 8.7 | 8.7 | 8.7 | 8.7 | 8.7 | 8.7 |
| 100° C. | $mm^2/s$ | 2.5 | 2.5 | 2.5 | 2.5 | 2.5 | 2.5 |
| (A) Ca detergent | | | | | | | |
| A-1 | mass % (Ca) | 0.01 | 0.015 | 0.015 | 0.015 | 0.015 | 0.015 |
| A-2* | mass % (Ca) | 0.005 | — | — | — | — | — |
| salicylates in soap groups | mol % | | 100 | 100 | 100 | 100 | 100 |
| (B) ashless dispersant | | | | | | | |
| B-1 | mass % (N) | 0.050 | 0.050 | 0.050 | 0.25 | 0.01 | 0.025 |
| B-2 | mass % (N) | — | — | — | — | — | 0.025 |
| (C) antioxidant | | | | | | | |
| C-1 | mass % (N) | 0.02 | 0.02 | 0.02 | 0.02 | 0.02 | 0.02 |
| C-2 | mass % (N) | — | — | — | — | — | — |
| (D) friction modifier | | | | | | | |
| D-1 | mass % (N) | — | — | — | — | — | — |
| (E) phosphite ester | | | | | | | |
| E-1 | mass % (P) | 0.035 | 0.01 | 0.06 | 0.035 | 0.035 | 0.035 |
| (F) metal deactivator | | | | | | | |
| F-1 | mass % | 0.05 | 0.05 | 0.05 | 0.05 | 0.05 | 0.05 |
| (G) other antioxidants | | | | | | | |
| G-1 | mass % | 0.5 | 0.5 | 0.5 | 0.5 | 0.5 | 0.5 |

TABLE 3-continued

| | | examples | | | | | |
|---|---|---|---|---|---|---|---|
| | | 13 | 14 | 15 | 16 | 17 | 18 |
| kinematic viscosity of composition | | | | | | | |
| 40° C. | $mm^2/s$ | 9.7 | 9.7 | 9.7 | 9.7 | 9.7 | 9.7 |
| 100° C. | $mm^2/s$ | 2.7 | 2.7 | 2.7 | 2.7 | 2.7 | 2.7 |
| viscosity index | | 131 | 131 | 131 | 131 | 131 | 131 |
| volume resistivity (80° C.) | | | | | | | |
| fresh oil | $10^{10}\Omega \cdot cm$ | 0.34 | 0.37 | 0.28 | 0.20 | 0.38 | 0.35 |
| oxidatively deteriorated oil | $10^{10}\Omega \cdot cm$ | 0.21 | 0.25 | 0.11 | 0.10 | 0.23 | 0.20 |
| Unisteel test | | | | | | | |
| fatigue life L50 | h | 19 | 19 | 21 | 19 | 20 | 20 |

TABLE 4

| | | examples | | | | |
|---|---|---|---|---|---|---|
| | | 19 | 20 | 21 | 22 | 23 |
| base oil composition | | | | | | |
| O-1 | mass % | 85 | 85 | 85 | 85 | 85 |
| O-2 | mass % | 15 | 15 | 15 | 15 | 15 |
| O-3 | mass % | — | — | — | — | — |
| O-4 | mass % | — | — | — | — | — |
| O-5 | mass % | — | — | — | — | — |
| O-6 | mass % | — | — | — | — | — |
| O-7 | mass % | — | — | — | — | — |
| kinematic viscosity of base oil | | | | | | |
| 40° C. | $mm^2/s$ | 8.7 | 8.7 | 8.7 | 8.7 | 8.7 |
| 100° C. | $mm^2/s$ | 2.5 | 2.5 | 2.5 | 2.5 | 2.5 |
| (A) Ca detergent | | | | | | |
| A-1 | mass % (Ca) | 0.015 | 0.015 | 0.015 | 0.015 | 0.015 |
| A-2* | mass % (Ca) | — | — | — | — | — |
| salicylates in soap groups | mol % | 100 | 100 | 100 | 100 | 100 |
| (B) ashless dispersant | | | | | | |
| B-1 | mass % (N) | 0.050 | 0.050 | 0.050 | 0.050 | 0.050 |
| B-2 | mass % (N) | — | — | — | — | — |
| (C) antioxidant | | | | | | |
| C-1 | mass % (N) | 0.005 | 0.02 | 0.02 | 0.02 | 0.02 |
| C-2 | mass % (N) | — | 0.1 | — | — | — |
| (D) friction modifier | | | | | | |
| D-1 | mass % (N) | — | — | — | — | — |
| (E) phosphite ester | | | | | | |
| E-1 | mass % (P) | 0.035 | 0.035 | 0.035 | 0.035 | 0.035 |
| (F) metal deactivator | | | | | | |
| F-1 | mass % | 0.05 | 0.05 | 0.05 | 0.05 | — |
| (G) other antioxidants | | | | | | |
| G-1 | mass % | 0.5 | 0.5 | — | 1.0 | 0.5 |
| kinematic viscosity of composition | | | | | | |
| 40° C. | $mm^2/s$ | 9.7 | 9.7 | 9.7 | 9.7 | 9.7 |
| 100° C. | $mm^2/s$ | 2.7 | 2.7 | 2.7 | 2.7 | 2.7 |
| viscosity index | | 131 | 131 | 131 | 131 | 131 |
| volume resistivity (80° C.) | | | | | | |
| fresh oil | $10^{10}\Omega \cdot cm$ | 0.23 | 0.23 | 0.34 | 0.31 | 0.35 |
| oxidatively deteriorated oil | $10^{10}\Omega \cdot cm$ | 0.11 | 0.14 | 0.19 | 0.18 | 0.21 |
| Unisteel test | | | | | | |
| fatigue life L50 | h | 21 | 20 | 20 | 19 | 20 |

TABLE 5

| | | examples | | | |
|---|---|---|---|---|---|
| | | 24 | 25 | 26 | 27 |
| base oil composition | | | | | |
| O-1 | mass % | 85 | 85 | 85 | 85 |
| O-2 | mass % | 15 | 15 | 15 | 15 |
| O-3 | mass % | — | — | — | — |
| O-4 | mass % | — | — | — | — |
| O-5 | mass % | — | — | — | — |
| O-6 | mass % | — | — | — | — |
| O-7 | mass % | — | — | — | — |
| kinematic viscosity of base oil | | | | | |
| 40° C. | $mm^2/s$ | 8.7 | 8.7 | 8.7 | 8.7 |
| 100° C. | $mm^2/s$ | 2.5 | 2.5 | 2.5 | 2.5 |
| (A) Ca detergent | | | | | |
| A-1 | mass % (Ca) | 0.015 | 0.015 | 0.015 | 0.015 |
| A-2* | mass % (Ca) | — | — | — | — |
| salicylates in soap groups | mol % | 100 | 100 | 100 | 100 |
| (B) ashless dispersant | | | | | |
| B-1 | mass % (N) | 0.050 | 0.050 | 0.050 | 0.050 |
| B-2 | mass % (N) | — | — | — | — |
| (C) antioxidant | | | | | |
| C-1 | mass % (N) | 0.02 | 0.02 | 0.02 | 0.02 |
| C-2 | mass % (N) | — | — | — | — |
| (D) friction modifier | | | | | |
| D-1 | mass % (N) | 0.001 | 0.01 | 0.02 | — |
| (E) phosphite ester | | | | | |
| E-1 | mass % (P) | 0.035 | 0.035 | 0.035 | — |
| (F) metal deactivator | | | | | |
| F-1 | mass % | 0.05 | 0.05 | 0.05 | — |
| (G) other antioxidants | | | | | |
| G-1 | mass % | 0.5 | 0.5 | 0.5 | — |
| kinematic viscosity of composition | | | | | |
| 40° C. | $mm^2/s$ | 9.7 | 9.7 | 9.7 | 9.7 |
| 100° C. | $mm^2/s$ | 2.7 | 2.7 | 2.7 | 2.7 |
| viscosity index | | 131 | 131 | 131 | 131 |
| volume resistivity (80° C.) | | | | | |
| fresh oil | $10^{10}\Omega \cdot cm$ | 0.30 | 0.29 | 0.29 | 0.36 |
| oxidatively deteriorated oil | $10^{10}\Omega \cdot cm$ | 0.18 | 0.14 | 0.10 | 0.24 |
| Unisteel test | | | | | |
| fatigue life L50 | h | 21 | 21 | 20 | 20 |

TABLE 6

| | | comparative examples | | | | |
|---|---|---|---|---|---|---|
| | | 1 | 2 | 3 | 4 | 5 |
| base oil composition | | | | | | |
| O-1 | mass % | 85 | 85 | 85 | 85 | 85 |
| O-2 | mass % | 15 | 15 | 15 | 15 | 15 |
| O-3 | mass % | — | — | — | — | — |
| O-4 | mass % | — | — | — | — | — |
| O-5 | mass % | — | — | — | — | — |
| O-6 | mass % | — | — | — | — | — |
| O-7 | mass % | — | — | — | — | — |
| kinematic viscosity of base oil | | | | | | |
| 40° C. | $mm^2/s$ | 8.7 | 8.7 | 8.7 | 8.7 | 8.7 |
| 100° C. | $mm^2/s$ | 2.5 | 2.5 | 2.5 | 2.5 | 2.5 |

TABLE 6-continued

| | | comparative examples | | | | |
|---|---|---|---|---|---|---|
| | | 1 | 2 | 3 | 4 | 5 |
| (A) Ca detergent | | | | | | |
| A-1 | mass % (Ca) | — | — | 0.035 | 0.015 | 0.015 |
| A-2* | mass % (Ca) | 0.015 | 0.03 | — | — | — |
| salicylates in soap groups | mol % | 0 | 0 | 100 | 100 | 100 |
| (B) ashless dispersant | | | | | | |
| B-1 | mass % (N) | 0.050 | 0.050 | 0.050 | 0.3 | 0.050 |
| B-2 | mass % (N) | — | — | — | — | — |
| (C) antioxidant | | | | | | |
| C-1 | mass % (N) | 0.02 | 0.02 | 0.02 | 0.02 | 0.02 |
| C-2 | mass % (N) | — | — | — | — | 0.15 |
| (D) friction modifier | | | | | | |
| D-1 | mass % (N) | — | — | — | — | — |
| (E) phosphite ester | | | | | | |
| E-1 | mass % (P) | 0.035 | 0.035 | 0.035 | 0.035 | 0.035 |
| (F) metal deactivator | | | | | | |
| F-1 | mass % | 0.05 | 0.05 | 0.05 | 0.05 | 0.05 |
| (G) other antioxidants | | | | | | |
| G-1 | mass % | 0.5 | 0.5 | 0.5 | 0.5 | 0.5 |
| kinematic viscosity of composition | | | | | | |
| 40° C. | $mm^2/s$ | 9.7 | 9.7 | 9.7 | 9.7 | 9.7 |
| 100° C. | $mm^2/s$ | 2.7 | 2.7 | 2.7 | 2.7 | 2.7 |
| viscosity index | | 131 | 131 | 131 | 131 | 131 |
| volume resistivity (80° C.) | | | | | | |
| fresh oil | $10^{10}\Omega \cdot cm$ | 0.34 | 0.28 | 0.18 | 0.18 | 0.20 |
| oxidatively deteriorated oil | $10^{10}\Omega \cdot cm$ | 0.22 | 0.22 | 0.05 | 0.08 | 0.09 |
| Unisteel test | | | | | | |
| fatigue life L50 | h | 10 | 9 | 21 | 20 | 20 |

(Volume Resistivity)

The volume resistivity of a fresh oil, and the volume resistivity of an oxidatively deteriorated oil were measured for each lubricating oil composition. The oxidatively deteriorated oil was obtained by oxidation treatment on the fresh oil at 165° C. in oil temperature for 150 hours by the ISOT (Indiana Stirring Oxidation Test) method, conforming to JIS K2514-1. The volume resistivity of the fresh oil, and the volume resistivity of the oxidatively deteriorated oil were each measured at 80° C. in oil temperature, conforming to the volume resistivity test specified in JIS C2101. The results are shown in tables 1 to 6. In this test, higher volume resistivity at 80° C. means better electrical insulation. The volume resistivity of the oxidatively deteriorated oil at 80° C. in this test is preferably no less than $1.0\times10^9$ Ω·cm.

(Unisteel Test)

For each lubricating oil composition, a rolling fatigue life of a thrust bearing was measured by a Unisteel test (IP305/79, The Institute of Petroleum) using a Unisteel rolling fatigue testing machine (triple-type high-temperature rolling fatigue testing machine (TRF-1000/3-01H) manufactured by Tokyo Koki Testing Machine Co. Ltd.). Time until either a roller or a test piece suffered fatigue damage was measured for a test bearing made by replacing a bearing ring in one side of a thrust needle bearing (FNTA-2542C manufactured by NSK Ltd.) with a flat test piece (material: SUJ2), under the conditions of: 7000 N in load; 2 GPa in surface pressure; 1450 rpm in rotation speed; and 120° C. in oil temperature. It was determined that fatigue damage occurred when the vibration acceleration of a testing portion measured by a vibration accelerometer installed in the Unisteel rolling fatigue testing machine reached 1.5 $m/s^2$. The test was repeated ten times, and then a fatigue life was calculated as the 50% life (L50: time for the cumulative probability to be 50%) by a Weibull plot based on the time it had taken for fatigue damage to occur in the tests. The results are shown in tables 1 to 6. A longer 50% life measured in this test means better anti-fatigue performance.

(Evaluation Results)

The lubricating oil compositions of examples 1 to 27 showed good results in anti-fatigue performance, and electrical insulation of the oxidatively deteriorated composition.

The lubricating oil compositions of comparative examples 1 and 2, which comprised a calcium sulfonate detergent instead of the component (A) (calcium salicylate detergent), showed results inferior in anti-fatigue performance.

The lubricating oil composition of comparative example 3, which comprised too high a content of the component (A), showed results inferior in electrical insulation of the oxidatively deteriorated composition.

The lubricating oil composition of comparative example 4, which comprised too high a content of the component (B), showed results inferior in electrical insulation of the oxidatively deteriorated composition.

The lubricating oil composition of comparative example 5, which comprised too high a content of the component (C), showed results inferior in electrical insulation of the oxidatively deteriorated composition.

We claim:

1. A lubricating oil composition consisting of:

a lubricant base oil; and at least three additives other than phosphoric acid, the at least three additives consisting of the following (i) and optionally (ii):

(i) at least three additives other than any nitrogen-containing friction modifier and other than any phosphoric acid, the (i) consisting of the following (i-1) and (i-2):

(i-1) an ashless dispersant consisting of a succinimide ashless dispersant in an amount of 0.005 to 0.25 mass % in terms of nitrogen on the basis of the total mass of the composition; and (i-2) at least two additives other than any ashless dispersant, the (i-2) consisting of:

at least one calcium salicylate detergent in an amount of 0.005 to 0.03 mass % in terms of calcium on the basis of the total mass of the composition; and at least one nitrogen-containing antioxidant in an amount of 0.005 to 0.15 mass % in terms of nitrogen on the basis of the total mass of the composition; and optionally one or more of:

(E) a phosphite ester compound; and (F) a tolyltriazole metal deactivator and/or a benzotriazole metal deactivator; and (ii) at least one nitrogen-containing friction modifier in an amount of no more than 0.001 mass % in terms of nitrogen on the basis of the total mass of the composition, wherein a total content of any metallic detergent is 0.005 to 0.03 mass % in terms of metal on the basis of the total mass of the composition;

wherein an oxidatively deteriorated oil of the composition has a volume resistivity at 80° C. of no less than $1.0\times10^{9}$ 106·cm, wherein the oxidatively deteriorated oil is obtained by oxidatively treating the composition for 150 hours by ISOT method conforming to JIS K2514-1; and wherein the succinimide ashless dispersant is a succinimide compound represented by the following general formula (2) or (3), or any combination thereof:

(2)

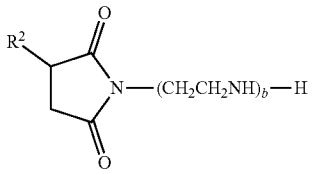

(3)

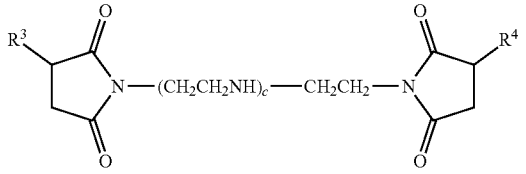

wherein in the general formula (2), $R^2$ represents a C40-400 alkyl or a C40-400 alkenyl; and b represents an integer of 1 to 5; and the compound represented by the general formula (2) may be a combination of a plurality of compounds having different values of b; and wherein in the general formula (3), $R^3$ and $R^4$ each independently represent a C40-400 alkyl or a C40-400 alkenyl, and may be any combination of different groups; and c is an integer of 0 to 4; and the compound represented by the general formula (3) may be a mixture of a plurality of compounds having different values of c.

2. The lubricating oil composition according to claim 1, wherein a proportion of any salicylate in a total soap group content of the metallic detergent is no less than 65 mol %.

3. The lubricating oil composition according to claim 1, the (ii) consisting of (D1) a succinimide friction modifier.

4. The lubricating oil composition according to claim 3, the component (D1) being a first condensation reaction product, or a derivative thereof, or any combination thereof, the first condensation reaction product being a condensation reaction product of a first alkyl- or alkenyl-succinic acid or anhydride thereof and a first polyamine, the first alkyl- or alkenyl-succinic acid having a C8-36 alkyl or alkenyl group, the first polyamine being a polyamine, a N-mono-C1-36 alkylated product of the polyamine, or a N-mono-C1-36 alkenylated product of the polyamine, or any mixture thereof.

5. The lubricating oil composition according to claim 1, wherein the (E) is present and represented by the following general formula (8) in an amount of 0.01 to 0.06 mass % in terms of phosphorus on the basis of the total mass of the composition:

(8)

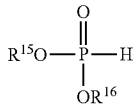

wherein in the general formula (8), $R^{15}$ and $R^{16}$ are each independently a C1-18 linear chain hydrocarbon group or a C5-20 group represented by the following general formula (9):

(9)

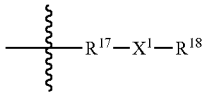

wherein in the general formula (9), $R^{17}$ is a C2-17 linear chain hydrocarbon group, and $R^{18}$ is a C3-17 linear chain hydrocarbon group, and $X^1$ is an oxygen atom or a sulfur atom.

6. The lubricating oil composition according to claim 1, wherein the (F) is present in an amount of 0.001 to 0.1 mass % on the basis of the total mass of the composition.

7. The lubricating oil composition according to claim 1, wherein the composition has a kinematic viscosity at 40° C. of 4 to 20 $mm^2/s$; and the composition has a kinematic viscosity at 100°° C. of 1.8 to 4.0 $mm^2/s$.

8. The lubricating oil composition according to claim 1, wherein the composition is used to lubricate an electric motor or to lubricate the electric motor and a transmission, in an automobile comprising the electric motor.

9. A method for lubricating an electric motor, the method comprising:

lubricating an electric motor installed in an automobile, by means of the lubricating oil composition as defined in claim 1.

10. A method for lubricating an electric motor and a transmission, the method comprising:

lubricating an electric motor and a transmission installed in an automobile, by means of the lubricating oil composition as defined in claim 1.

11. The lubricating oil composition according to claim 1, wherein an oxidatively deteriorated oil of the composition has a volume resistivity at 80° C. of no less than $1.4\times10^9$ Ω.cm, wherein the oxidatively deteriorated oil is obtained by oxidatively treating the composition for 150 hours by ISOT method conforming to JIS K2514-1.

12. The lubricating oil composition according to claim 1, wherein an oxidatively deteriorated oil of the composition has a volume resistivity at 80° C. of no less than $1.7\times10^9$ Ω·cm, wherein the oxidatively deteriorated oil is obtained by oxidatively treating the composition for 150 hours by ISOT method conforming to JIS K2514-1.

13. The lubricating oil composition according to claim 1, wherein an oxidatively deteriorated oil of the composition has a volume resistivity at 80° C. of no less than $1.8\times10^9$ Ω·cm, wherein the oxidatively deteriorated oil is obtained by oxidatively treating the composition for 150 hours by ISOT method conforming to JIS K2514-1.

14. A lubricating oil composition consisting of:

a lubricant base oil; and at least three additives other than phosphoric acid, the at least three additives consisting of the following (i) and (ii):

(i) at least two additives other than any ashless dispersant and other than phosphoric acid, the (i) consisting of at least one calcium salicylate detergent in an amount of 0.005 to 0.03 mass % in terms of calcium on the basis of the total mass of the composition;

at least one nitrogen-containing antioxidant in an amount of 0.005 to 0.15 mass % in terms of nitrogen on the basis of the total mass of the composition; and optionally at least one nitrogen-containing friction modifier in an amount of no more than 0.03 mass % in terms of nitrogen on the basis of the total mass of the composition; and (ii) an ashless dispersant, the (ii) consisting of a non-boron-containing succinimide ashless dispersant in an amount of 0.005 to 0.25 mass % in terms of nitrogen on the basis of the total mass of the composition, wherein a total content of any metallic detergent is 0.005 to 0.03 mass % in terms of metal on the basis of the total mass of the composition;

wherein an oxidatively deteriorated oil of the composition has a volume resistivity at 80°° C. of no less than $1.0\times10^9$ Ω·cm, wherein the oxidatively deteriorated oil is obtained by oxidatively treating the composition for 150 hours by ISOT method conforming to JIS K2514-1; and wherein the non-boron-containing succinimide ashless dispersant is a succinimide compound represented by the following general formula (2) or (3), or any combination thereof:

(2)

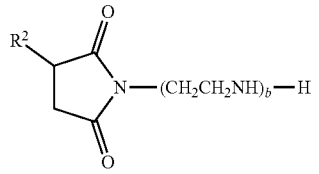

(3)

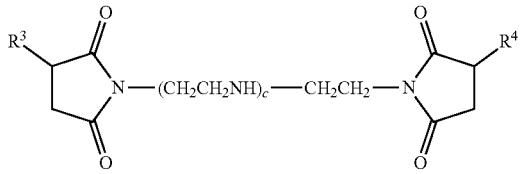

wherein in the general formula (2), $R^2$ represents a C40-400 alkyl or a C40-400 alkenyl; and b represents an integer of 1 to 5; and the compound represented by the general formula (2) may be a combination of a plurality of compounds having different values of b; and wherein in the general formula (3), $R^3$ and $R^4$ each independently represent a C40-400 alkyl or a C40-400 alkenyl, and may be any combination of different groups; and c is an integer of 0 to 4; and the compound represented by the general formula (3) may be a mixture of a plurality of compounds having different values of c.

15. The lubricating oil composition according to claim 14, wherein the at least one nitrogen-containing friction modifier consists of a succinimide friction modifier.

16. The lubricating oil composition according to claim 15, wherein the succinimide friction modifier being a first condensation reaction product, or a derivative thereof, or any combination thereof, the first condensation reaction product being a condensation reaction product of a first alkyl- or alkenyl-succinic acid or anhydride thereof and a first polyamine, the first alkyl- or alkenyl-succinic acid having a C8-36 alkyl or alkenyl group, the first polyamine being a polyamine, a N-mono-C1-36 alkylated product of the polyamine, or a N-mono-C1-36 alkenylated product of the polyamine, or any mixture thereof.

17. A lubricating oil composition consisting of:

a lubricant base oil; and at least three additives other than phosphoric acid, the at least three additives consisting of the following (i) and (ii):

(i) a succinimide additive, the (i) consisting of a succinimide ashless dispersant in an amount of 0.005 to 0.25 mass % in terms of nitrogen on the basis of the total mass of the composition; and (ii) at least two additives other than any succinimide compound and other than phosphoric acid, the (ii) consisting of:

at least one calcium salicylate detergent in an amount of 0.005 to 0.03 mass % in terms of calcium on the basis of the total mass of the composition;

at least one nitrogen-containing antioxidant in an amount of 0.005 to 0.15 mass % in terms of nitrogen on the basis of the total mass of the composition; and optionally at least one nitrogen-containing friction modifier other than any succinimide compound, in an amount of no more than 0.001 mass % in terms of nitrogen on the basis of the total mass of the composition, wherein a total content of any metallic detergent is 0.005 to 0.03 mass % in terms of metal on the basis of the total mass of the composition;

wherein an oxidatively deteriorated oil of the composition has a volume resistivity at 80° C. of no less than $1.0\times10^{9}$ Ω·cm, wherein the oxidatively deteriorated oil is obtained by oxidatively treating the composition for 150 hours by ISOT method conforming to JIS K2514-1; and wherein the succinimide ashless dispersant is a succinimide compound represented by the following general formula (2) or (3), or any combination thereof:

(2)

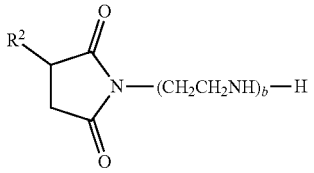

-continued (3)

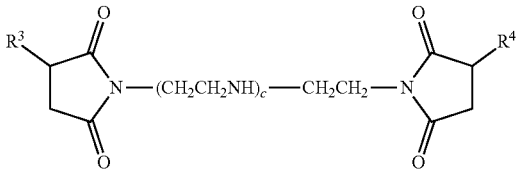

wherein in the general formula (2), $R^2$ represents a C40-400 alkyl or a C40-400 alkenyl; and b represents an integer of 1 to 5; and the compound represented by the general formula (2) may be a combination of a plurality of compounds having different values of b; and wherein in the general formula (3), $R^3$ and $R^4$ each independently represent a C40-400 alkyl or a C40-400 alkenyl, and may be any combination of different groups; and c is an integer of 0 to 4; and the compound represented by the general formula (3) may be a mixture of a plurality of compounds having different values of c.

* * * * *